United States Patent [19]

Ohki et al.

[11] 4,204,490

[45] May 27, 1980

[54] OVER-ROTATION PREVENTION METHOD AND CIRCUIT IN THE NON-CONTACT TYPE IGNITION CIRCUIT FOR THE INTERNAL COMBUSTION ENGINE

[75] Inventors: Yoshinori Ohki; Komiya Hirokichi, both of Tokyo, Japan

[73] Assignee: Iida Denki Kogyo K.K., Tokyo, Japan

[21] Appl. No.: 907,059

[22] Filed: May 17, 1978

Related U.S. Application Data

[62] Division of Ser. No. 748,462, Dec. 8, 1976, Pat. No. 4,144,859.

[30] Foreign Application Priority Data

| | | | |
|---|---|---|---|
| Dec. 15, 1975 | [JP] | Japan | 50-149297 |
| Dec. 15, 1975 | [JP] | Japan | 50-149298 |
| Feb. 9, 1976 | [JP] | Japan | 51-13028 |
| Mar. 4, 1976 | [JP] | Japan | 51-23592 |
| Apr. 8, 1976 | [JP] | Japan | 51-39754 |
| Apr. 16, 1976 | [JP] | Japan | 51-43181 |

[51] Int. Cl.[2] ..... F02P 1/00

[52] U.S. Cl. ..... 123/102; 123/148 CC; 123/148 E

[58] Field of Search ..... 123/102, 148 CC, 148 E

[56] References Cited

U.S. PATENT DOCUMENTS

| | | | |
|---|---|---|---|
| 3,356,082 | 12/1967 | Jukes | 123/102 |
| 3,809,044 | 5/1974 | Jereb et al. | 123/148 CC |
| 3,828,753 | 8/1974 | Reddy | 123/148 CC |
| 3,958,546 | 5/1976 | Ohki et al. | 123/148 E |
| 3,964,461 | 6/1976 | Wesemeyer et al. | 123/148 CC |
| 3,967,604 | 7/1976 | Kondo | 123/102 |
| 4,014,309 | 3/1977 | Nagasawa | 123/148 CC |
| 4,038,951 | 8/1977 | Schweikast | 123/148 CC |
| 4,079,712 | 3/1978 | Nagasawa | 123/148 CC |
| 4,090,488 | 5/1978 | Ohki et al. | 123/148 E |
| 4,116,188 | 9/1978 | Nagasawa | 123/148 CC |

*Primary Examiner*—Charles J. Myhre
*Assistant Examiner*—R. A. Nelli
*Attorney, Agent, or Firm*—Fidelman, Wolffe & Waldron

[57] ABSTRACT

In a non contact ignition circuit for an internal combustion engine, a current induced in the primary winding or an ignition coil is controlled and cut-off by operation, on and off, of a thyristor so as to produce a discharge in a spark plug. A capacitor connected to the gate of the thyristor is charged with an inverse voltage. When the rotational speed of the internal combustion engine exceeds a predetermined level, i.e. a state of overrotation, the inverse voltage stored in the capacitor is discharged whereby the gate potential of the thyristor is negatively biased relative to the cathode. Accordingly, during the discharging period of the capacitor, the triggering time of the thyristor and sparking are retarded as compared to the normal running condition of the internal combustion engine. Thereby overrotation of the internal combustion engine is prevented.

7 Claims, 36 Drawing Figures

OVER-ROTATION PREVENTION METHOD AND CIRCUIT IN THE NON-CONTACT TYPE IGNITION CIRCUIT FOR THE INTERNAL COMBUSTION ENGINE

This is a division of application Ser. No. 748,462 filed Dec. 8, 1976 now U.S. Pat. No. 4,144,859.

DESCRIPTION OF THE PRIOR ART

Ohki, et al (U.S. Pat. No. 3,958,546) discloses the use of an AC magneto generator driven by the engine to induce voltage into the primary of the ignition coil as well as into a trigger coil for a trigger circuit.

The inductive mechanism of the aforementioned patent (U.S. Pat. No. 3,958,546) is representative of the prior art available to one of ordinary skill in the art and which prior art may be utilized in the instant invention.

This invention relates to an overrotation prevention method in a non-contact ignition circuit for an internal combustion engine and an overrotation prevention circuit embodying the method.

The term "overrotation" herein refers to a state where engine rotational speed abnormally increases, and particularly, this tends to occur when load is rapidly changed from full load to no-load. Prior art approaches adapted to prevent overrotation of an internal combustion engine often include a governor mechanism of mechanical structure, or when rotational speed of the internal combustion engine exceeds a predetermined level, spark discharge at the spark plugs is stopped.

In accordance with the above-mentioned second approach in which spark discharge at the plug is stopped, gas is forced into the engine cylinder, which poses a difficulty in providing re-ignition and various other inconveniences. For this reason, generally, the governor mechanism has been utilized.

The governor mechanism, comprises a flyweight and a spring coupled to the flyweight. An increase of the centrifugal force acting on the flyweight, which increases in proportion to the rotational speed of the crank shaft, causes a displacement against the spring force of the flyweight so as to control excessive rotational speed of the internal combustion engine.

As described above, the conventional mechanical governor mechanism requires the flyweight and the spring. In addition, there is required a space large enough to allow the flyweight to rotate since the latter rotates integral with the crank shaft. Space enough to allow the crank shaft to be displaced as the rotational speed thereof varies is also required. Hence, the mechanism becomes extremely bulky. As a consequence, it is difficult for the governor mechanism, which is often mounted in a very narrow space, to be mounted on the internal combustion engine, and above all, the mechanical service life thereof is decreased due to deterioration of the spring and the like.

Various overrotation prevention circuits have recently been proposed for electrically retarding ignition timing in an ignition circuit to prevent overrotation of the internal combustion engine in an effort to avoid various disadvantages noted above with respect to the mechanical governor mechanism. In accordance with most of the aforementioned circuits, however, there is a limitation in the angle of delay; the amount of delay is maintained at a given value by operation of the overrotation prevention circuit. Thus, in the case where the rotational speed of the internal combustion engine tends to increase, for some reason despite operation of the overrotation prevention circuit, it is impossible in the prior circuits to inhibit such an increase of the rotational speed. Another problem with the prior art circuits is that the overrotation prevention circuit at a time of normal rotational speed of the internal combustion engine, causes normal ignition timing to be retarded slightly.

The present invention eliminates the disadvantages and inconvenience noted above with respect to the aforementioned prior art examples by providing a method and apparatus for preventing overrotation of an internal combustion engine. The apparatus comprises a non-contact ignition circuit for an internal combustion engine in which a current induced in a primary winding or an ignition coil, with a plug connected to a secondary winding thereof, is controlled in its conduction and cut-off by the operation, on and off, of a thyristor so as to produce a spark discharge in the plug. When rotational speed of the internal combustion engine exceeds a predetermined level, i.e., overrotation, the inverse voltage stored in a capacitor connected to the gate of the thyristor is discharged to drop the gate potential of the thyristor, thereby retarding the triggering time of the thyristor and the time of sparking. During the discharging of the capacitor, overrotation of the internal combustion engine is prevented.

Accordingly, it is an object of this invention to electrically prevent overrotation of an internal combustion engine.

Another object of this invention is to increase the overrotation prevention response as the overrotation of the internal combustion engine increases.

Another object of this invention is to initiate the overrotation prevention operation in accordance with an induced voltage which increases in proportion to rotational speed of the internal combustion engine.

Still another object of this invention is to prevent the ignition circuit from being electrically influenced by the overrotation prevention circuit when the internal combustion engine is in normal running condition.

Still another object of this invention is to enable free selection of the rotational speed for commencing an overrotation prevention operation of the internal combustion engine without influencing the normal ignition circuit.

The invention will be better understood from a reading of the following detailed description thereof, when taken in conjunction with the drawing wherein.

Figure 9:
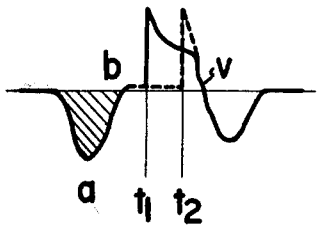
Figure 2:
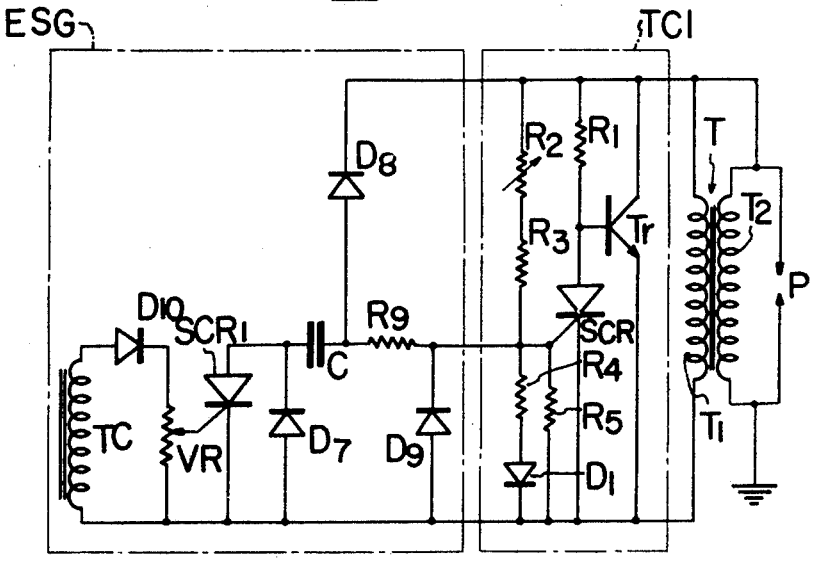
FIG. 2 is a schematic electric connection diagram illustrating a basic circuit of this invention.
Figure 3:
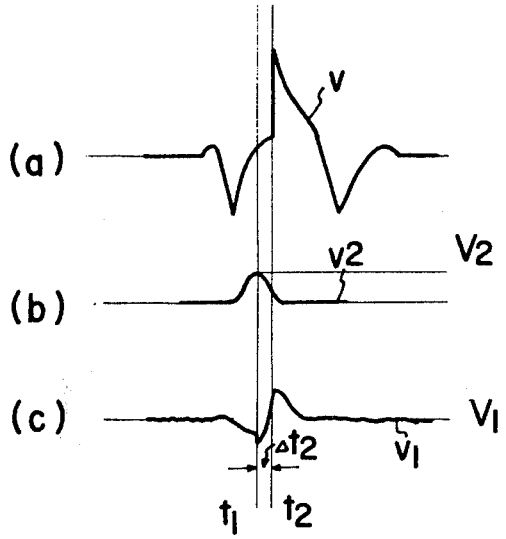
Figure 4:
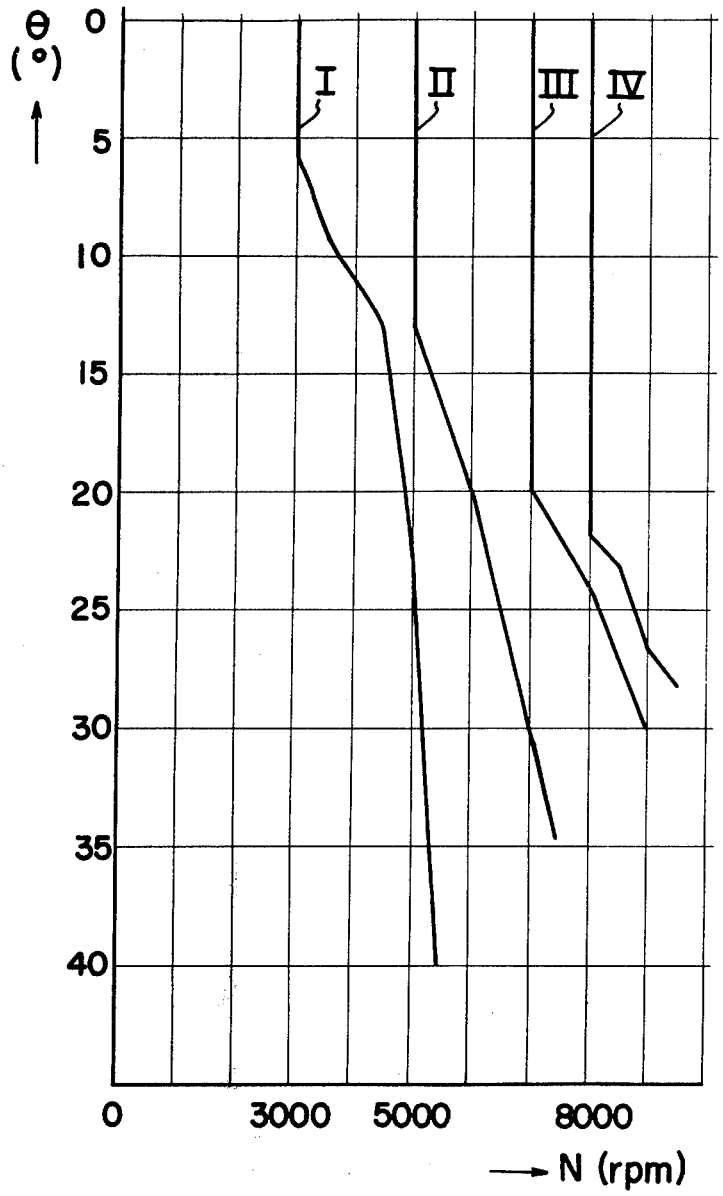
Figure 5:
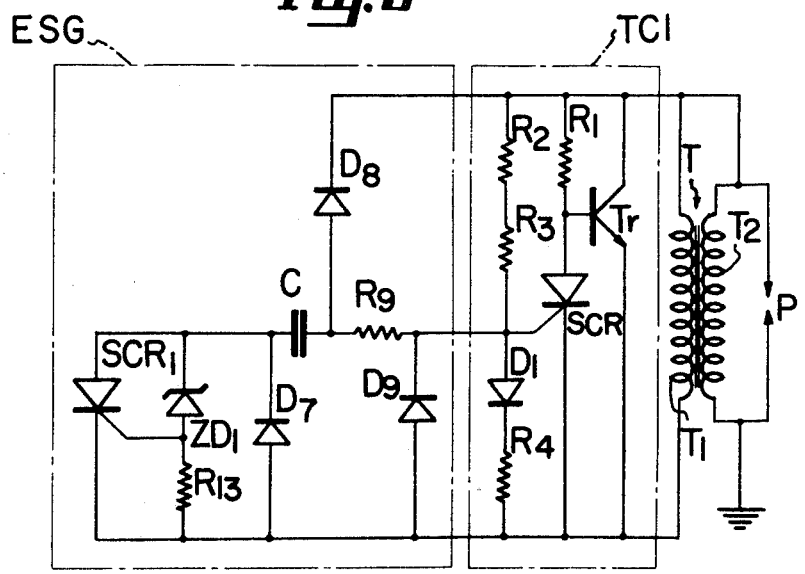
Figure 6:
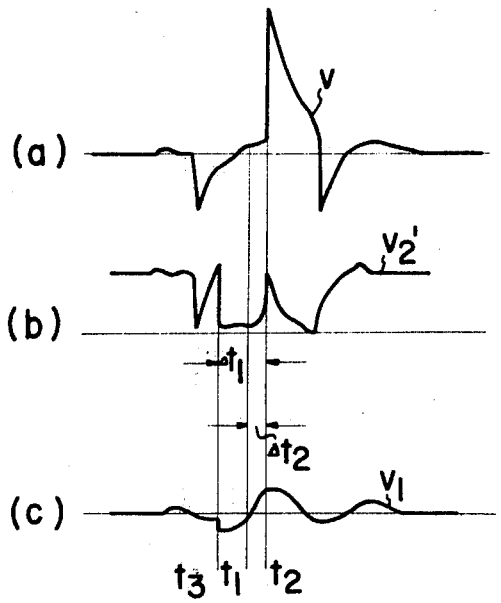
Figure 7B:
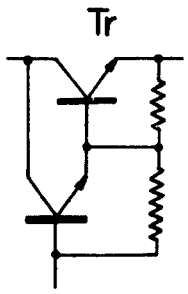
Figure 7A:
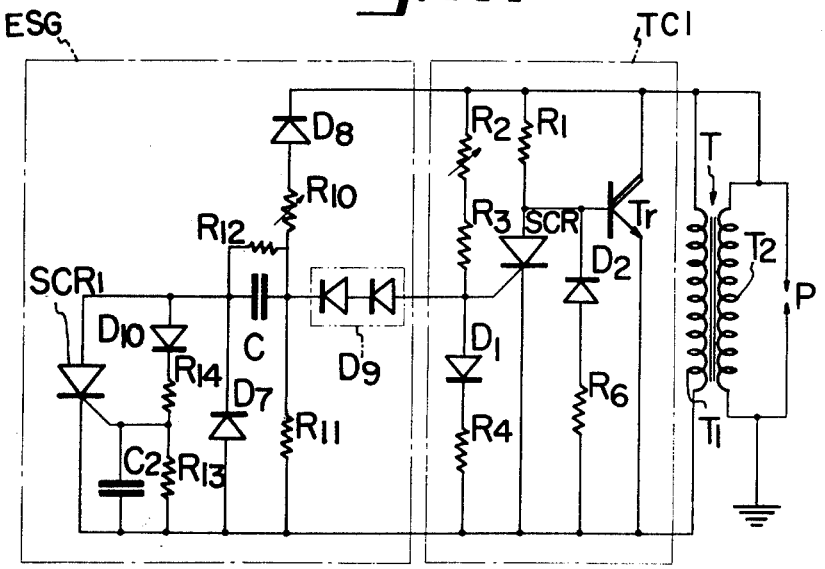
Figure 8:
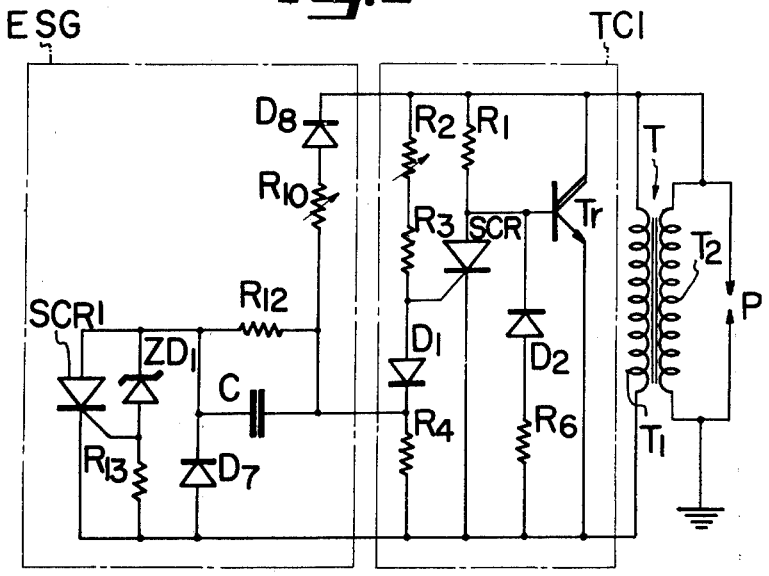
Figure 10:
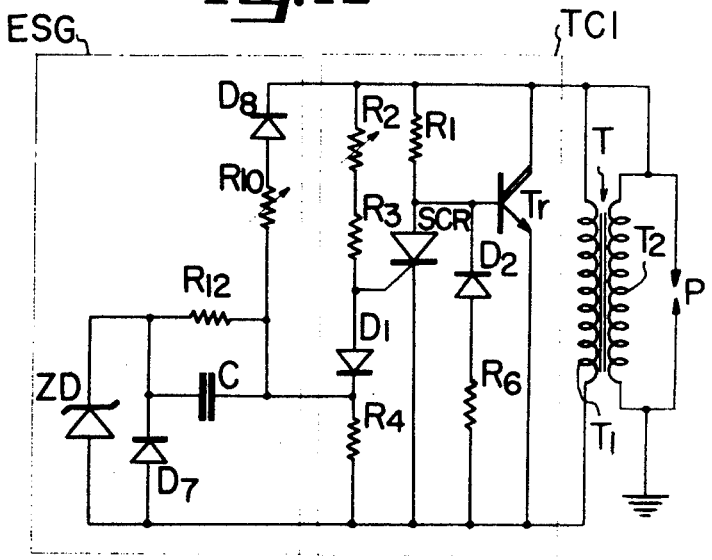
Figure 11:
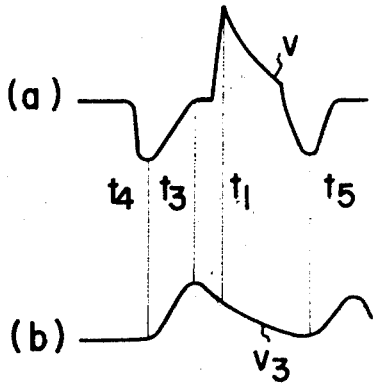
Figure 12:
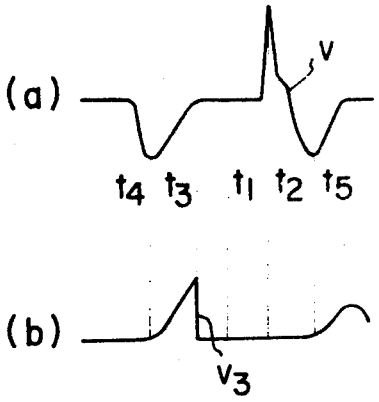
Figure 13:
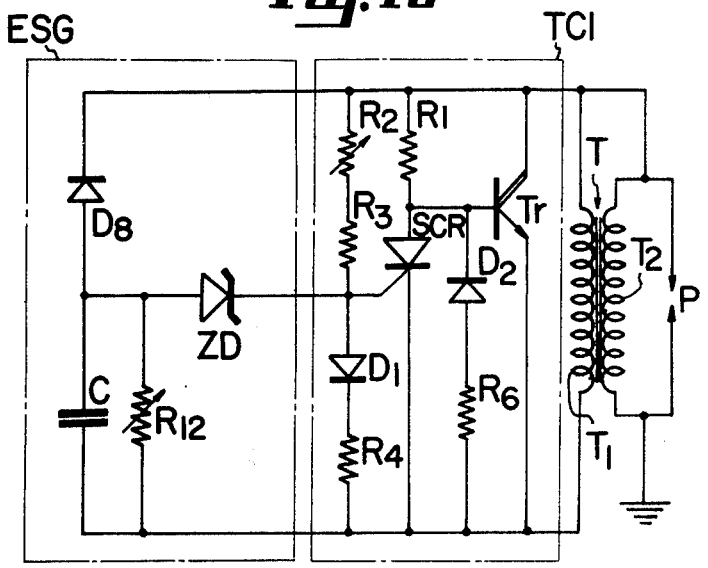
Figure 14:
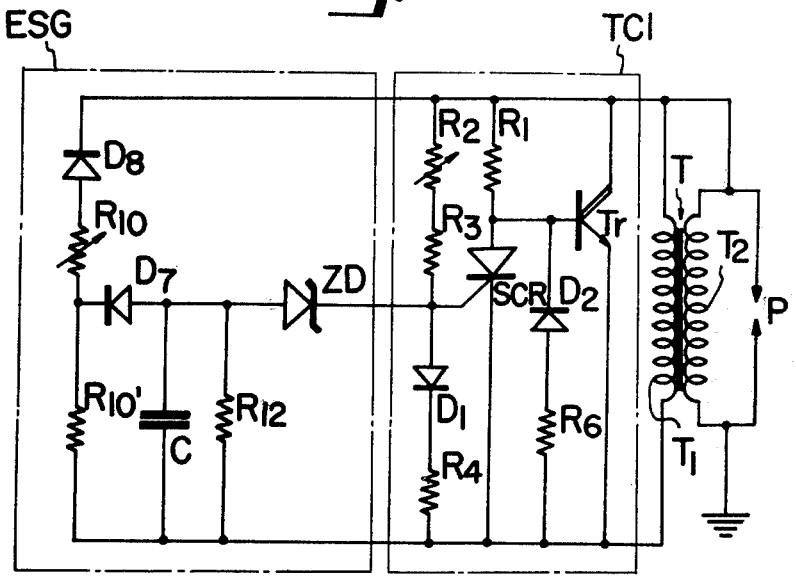
Figure 15:
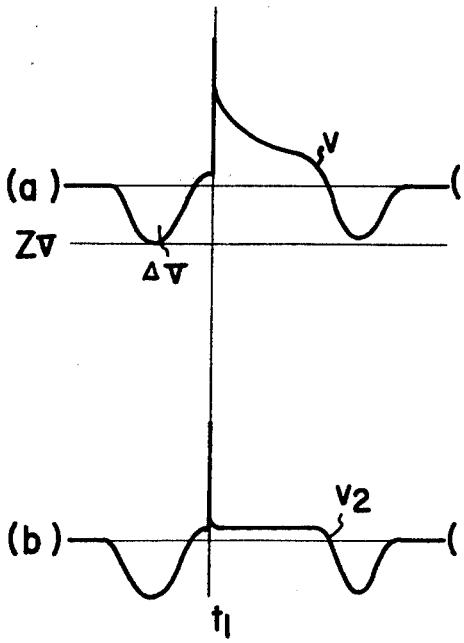

FIG. 3 illustrates operating voltage waveforms in the circuit shown in FIG. 2, FIG. 3 (*a*) illustrates a voltage waveform formed between opposite terminals of a primary winding. FIG. 3 (*b*) illustrates a gate voltage waveform of a thyristor forming a discharge switch circuit. FIG. 3 (*c*) illustrates a gate voltage waveform of a thyristor in the ignition circuit;

FIG. 4 is a diagram of operating characteristics showing the magnitude of angle of lag relative to rotational speed in the overrotation prevention circuit shown in FIG. 2;

FIG. 5 is an alternative schematic electric connection diagram of this invention showing an improvement over that shown in FIG. 2 wherein the discharge switch circuit is triggered in accordance with the discharging voltage of a capacitor;

FIG. 6 illustrates voltage waveforms at essential parts in the circuit shown in FIG. 5, in which FIG. 6 (*a*) illustrates a voltage waveform formed between opposite terminals of a primary winding, FIG. 6 (*b*) illustrates a voltage waveform between anode and cathode of a thyristor forming a discharge switch circuit, and FIG. 6 (*c*) illustrates a gate voltage waveform of a thyristor in the ignition circuit;

FIG. 7 is a schematic electric connection diagram in the form of a further improvement from that shown in FIG. 5, in which an electrical influence from the ignition circuit to the circuit of the invention is entirely eliminated to prevent malfunction of the circuit of the invention and another electrical influence from the circuit of the invention to the ignition circuit is eliminated to entirely avoid disordering of normal operation of the ignition circuit;

FIG. 8 is a simplified circuit representation making a use of a basic conception of the preferred embodiment shown in FIG. 7 without modification;

FIG. 9 illustrates voltage waveforms formed between the opposite terminals of the primary winding in the preferred embodiments shown in FIGS. 7 and 8, the aforesaid voltage waveforms being identical to those of the embodiment shown in FIG. 5;

FIG. 10 is a circuit diagram in which a discharge switch circuit comprises a Zener diode with a capacitor charging power source comprised of a primary winding of an ignition coil in the induction discharging type ignition circuit;

FIG. 11 illustrates voltage waveforms of essential parts when the circuit shown in FIG. 10 is in operation at normal rotational speed;

FIG. 12 illustrates voltage waveforms of essential parts at the time of overrotation speed, where v indicates the voltage between opposite terminals of a primary winding and $v_3$ indicates the voltage between anode and cathode of a Zener diode;

FIG. 13 and FIG. 14 are circuit diagrams with a resistance circuit comprised of a Zener diode forming a discharge switch circuit, among forms disposed in an induction discharge type ignition circuit and in which a capacitor charging power source comprises a primary winding, wherein FIG. 13 is a basic circuit thereof and FIG. 14 is a circuit in the form of an improvement from that shown in FIG. 13;

FIG. 15 illustrates voltage waveforms of essential parts in the preferred embodiments shown in FIGS. 13 and 14 when the circuit of the invention is not in operation, in which FIG. 15 (*a*) illustrates a voltage waveform between opposite terminals of a primary winding and FIG. 15 (*b*) illustrates a gate voltage waveform of a thyristor.

Figure 16:
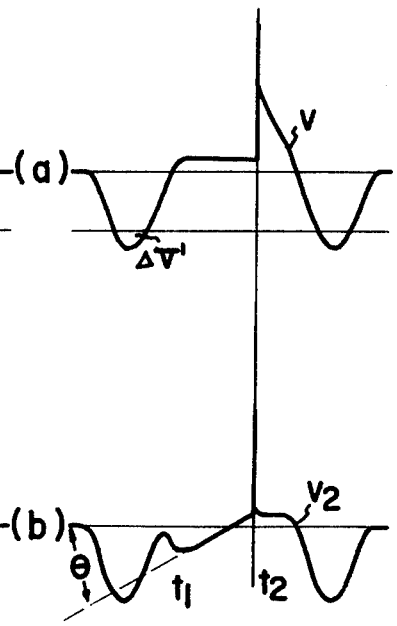
Figure 17:
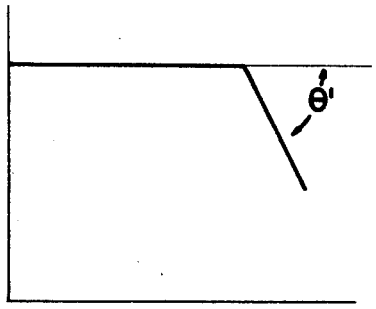
Figure 18:
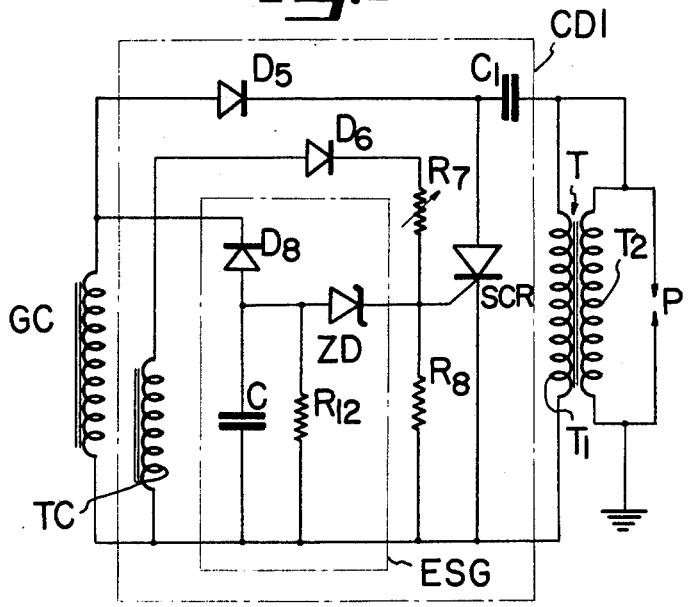
Figure 19:
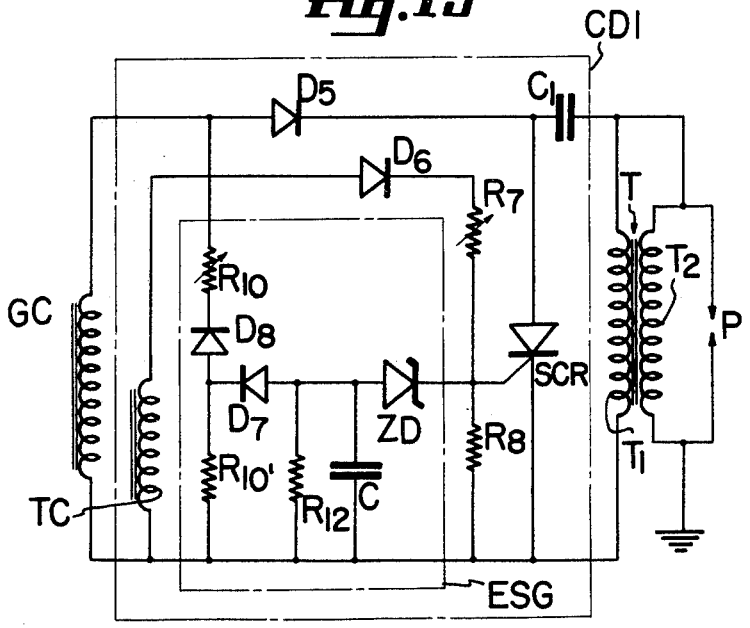
Figure 20:
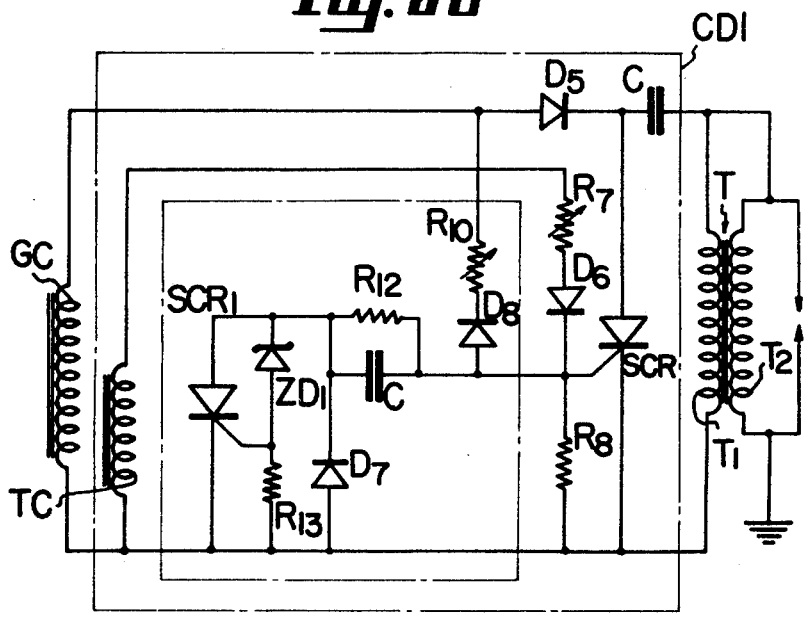
Figure 21:
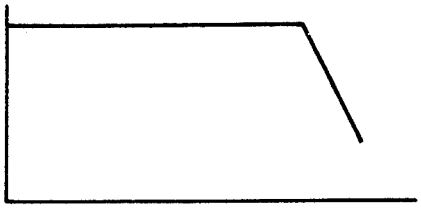
Figure 22:
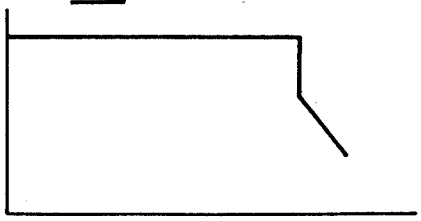
Figure 23:
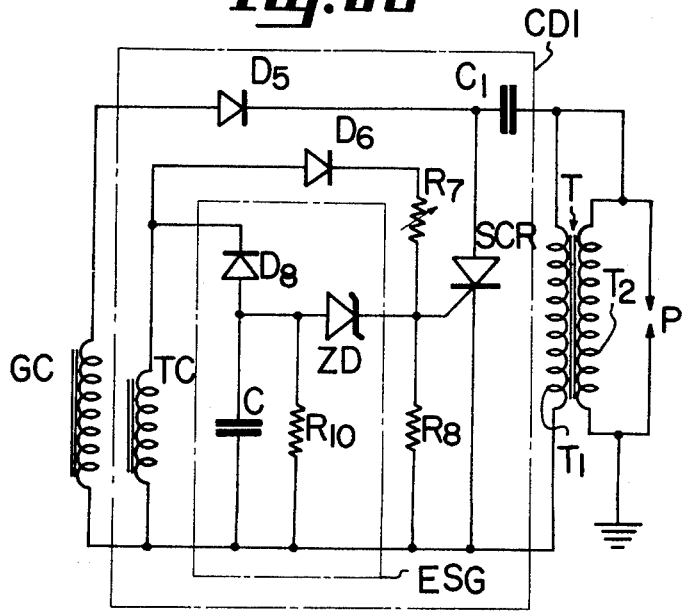
Figure 24:
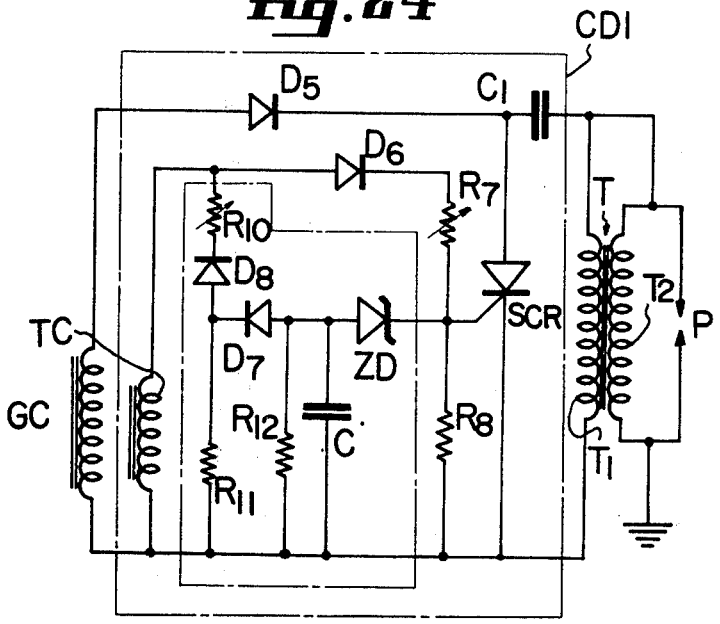
Figure 25:
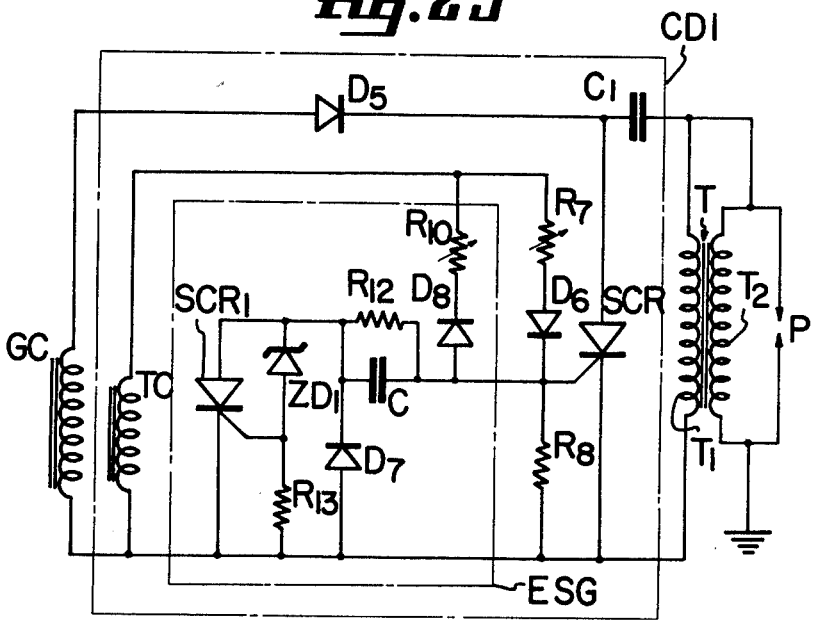
Figure 26:
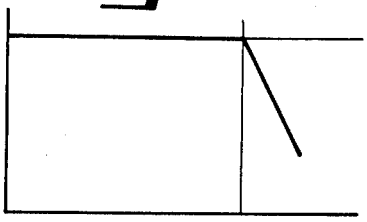
Figure 27:
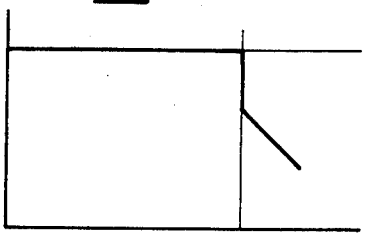
Figure 28:
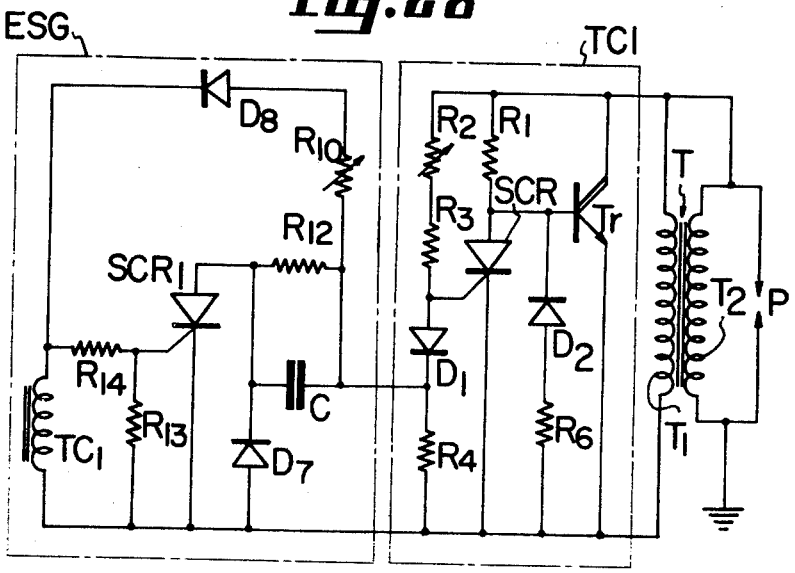
Figure 29:
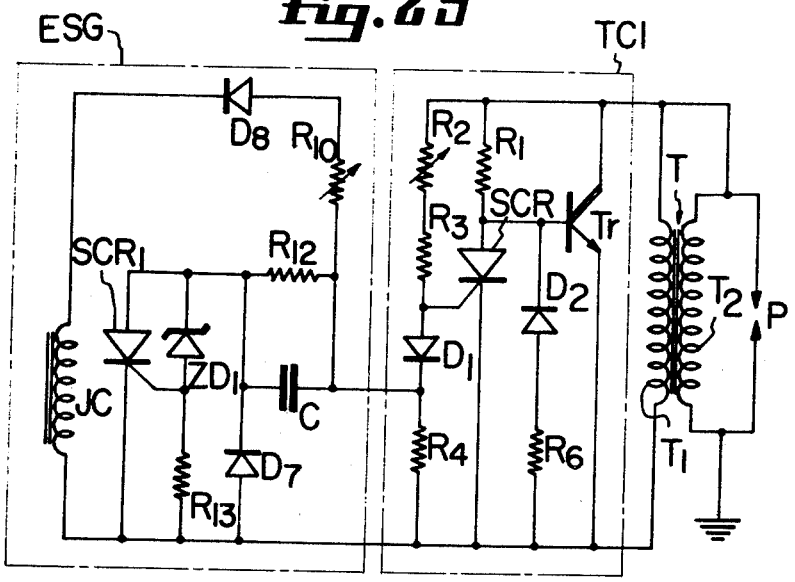
Figure 30:
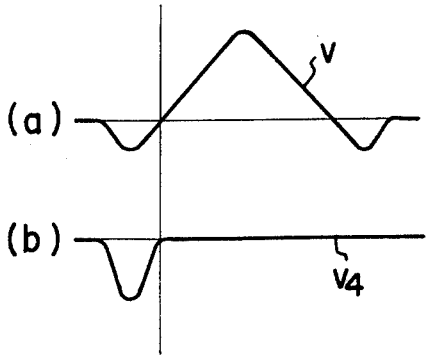
Figure 31:
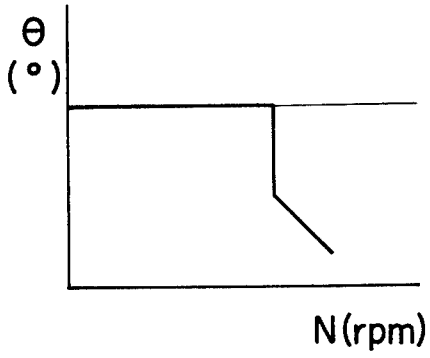
Figure 32:
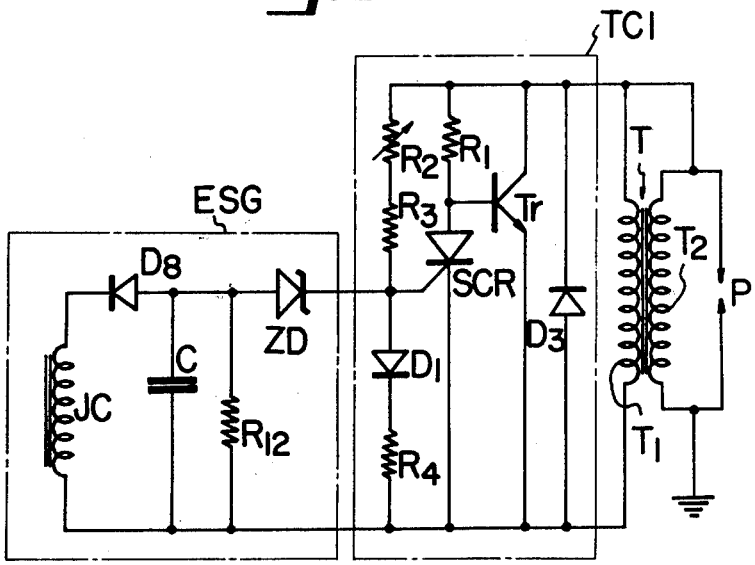
Figure 33:
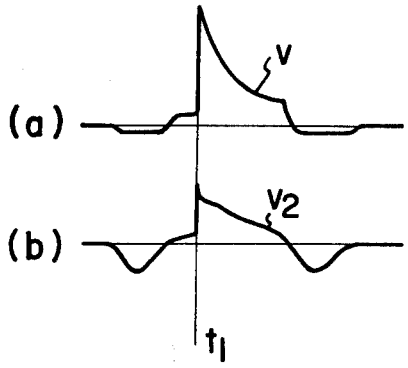
Figure 34:
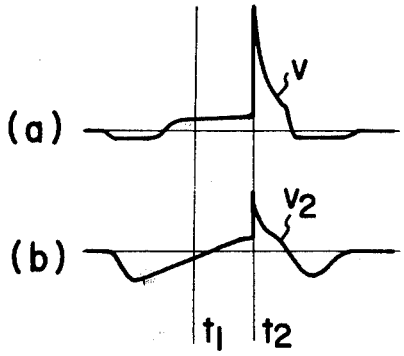
Figure 35:
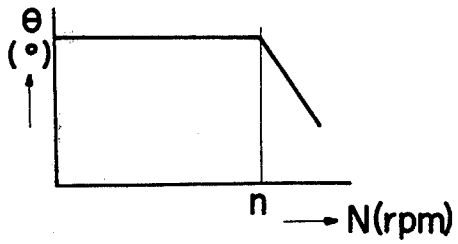

FIG. 16 illustrates voltage waveforms of essential parts in the preferred embodiments shown in FIGS. 13 and 14 when the circuit of the invention is in operation, in which FIG. 16 (*a*) illustrates a voltage waveform between opposite terminals of a primary winding and FIG. 16 (*b*) illustrates a gate voltage waveform of a thyristor;

FIG. 17 is a diagram showing an operating characteristic of an angle of lag relative to rotational speed of the internal combustion engine in the circuit of the invention shown in FIGS. 13 and 14;

FIGS. 18–20 and FIGS. 23–24 illustrate preferred embodiments in which the circuit of the invention is applied to a capacity discharge type ignition circuit, wherein FIGS. 18–20 are circuits in which a capacitor charging power source comprises a generation coil, and FIGS. 23–25 are circuits in which a capacitor charging power source comprises a trigger coil of a thyristor;

FIGS. 18 and 23 are basic circuits in which a Zener diode forming a discharge switch circuit also serve as a resistance circuit, and FIGS. 19 and 24 are circuits in the form of an improvement from those shown in FIGS. 18 and 23;

FIGS. 20 and 25 are basic circuits in which a discharge switch circuit comprises a thristor;

FIGS. 21 and 26 are diagrams showing operating characteristics of an angle of lag relative to rotational speed of the internal combustion engine in the preferred embodiments shown in FIGS. 18, 19, 23 and 24;

FIGS. 22 and 27 are diagrams showing operating characteristics of an angle of lag relative to rotational speed of the internal combustion engine in the preferred embodiments shown in FIGS. 20 and 25;

FIG. 28 is a circuit diagram in which a trigger coil of a thyristor forming a discharge switch circuit disposed in an induction discharge type ignition circuit comprises an inverse voltage source of a capacitor;

FIG. 29 is a circuit diagram having a charging coil exclusively used as an inverse voltage source for a capacitor disposed in an induction discharge ignition circuit and in which a discharge switch circuit comprises a thyristor;

FIG. 30 is a diagram showing timing of inverse voltage generation in a trigger coil or a charging coil relative to an induced voltage in a primary winding;

FIG. 31 is a diagram showing an operating characteristic of an angle of lag relative to rotational speed of the internal combustion engine in the preferred embodiments shown in FIGS. 28 and 29;

FIG. 32 is a circuit diagram, the circuit being disposed in an induction discharge type ignition circuit, having a charging coil exclusively used as an inverse voltage source for a capacitor and in which a Zener diode forming a discharge switch circuit also serves as a resistance circuit;

FIG. 33 illustrates waveforms showing a voltage between opposite terminals of a primary winding and a gate voltage of a thyristor when the circuit of the present invention is not in operation;

FIG. 34 illustrates waveforms showing a voltage between opposite terminals of a primary winding and a gate voltage of a thyristor when the circuit of the present invention is in operation; and FIG. 35 is a diagram showing an operating characteristics of an angle of lag relative to rotational speed of the internal combustion engine in the preferred embodiment shown in FIG. 32.

Various embodiments of the present invention will now be described with reference to the accompanying drawings.

As previously mentioned, the present invention is applied to a non-contact ignition circuit for an internal combustion engine in which a current, induced in the primary winding $T_1$ of an ignition coil T having a plug P connected to the secondary winding $T_2$, is controlled and cut-off by the on and off action of a thyristor SCR. The ignition circuits, to which this invention is applied, are roughtly divided into two types, namely, an induction discharge type ignition circuit (TCI) and a capacity discharge type ignition circuit (CDI).

The induction discharge type ignition circuit (FIG. 2) TCI comprises a resistor $R_1$ inserted as a base resistor between the collector and base of a transistor Tr. The transistor Tr is connected in parallel with the primary winding $T_1$ of the ignition coil T. A thyristor SCR is inserted between the base and emitter of the transistor Tr with the thyristor anode connected to the base. A resistance circuit comprising a resistor $R_2$ (in the form of a variable resistor for setting the trigger time of the thyristor SCR) and a series resistor $R_3$ are inserted between the gate of the thyristor SCR and collector of the transistor Tr. A series circuit comprising a diode $D_1$ (for temperature compensation) in series with a resistor $R_4$ is inserted between the gate and cathode of the thyristor SCR.

In the ignition circuit (TCI), as is apparent from its construction (see FIGS. 2, 5 and 7), when a forward induced voltage is produced in the primary winding $T_1$, such that a base current flows into the base of the transistor Tr through the resistor $R_1$, the transistor Tr is placed in conduction. Thus, current flows in the primary winding $T_1$ through the transistor Tr.

When the primary current increases in value, as the induced voltage in the primary winding $T_1$ increases, a shunt current flowing into the gate circuit of the thyristor SCR through resistors $R_2$, $R_3$, $R_4$, $R_5$ and $D_1$ also increases. Finally, the voltage drop in the gate circuit reaches the trigger voltage of the thyristor SCR at a time in the induced voltage cycle set by the value of the resistor $R_2$. As a consequence the thyristor SCR turns on.

When the thyristor SCR turns on, the potential difference between the base and emitter of the transistor Tr is almost zero, because the thyristor SCR shunts across the base and emitter so that the transistor Tr is cut off at the moment when the thyristor SCR turns on. When the transistor Tr current is cut off, the current flowing into the primary winding $T_1$ is rapidly cut off.

This rapid cut off of the current flowing into the primary winding $T_1$ causes a high voltage to be induced in the secondary winding $T_2$ of the transformer T and produces a spark discharge in plug P.

On the other hand, the capacity discharge type ignition circuit (see FIGS. 18–20) comprises: a series circuit including a rectifying diode $D_5$ and a capacitor $C_1$ inserted between the generation coil GC and the primary winding $T_1$ of the ignition coil T; a thyristor SCR connected in parallel with a series circuit comprising a capacitor $C_1$ and the primary winding $T_1$ with the anode thereof connected to the capacitor $C_1$; and the parallel circuit comprising in series a trigger coil TC, a rectifying diode $D_6$ and a resistor $R_7$ as a current limiting variable resistor, and a resistor $R_8$ as a gate resistor inserted between gate and cathode of the thyristor SCR.

In the ignition circuit CDI, as is apparent from its construction, a forward voltage induced in the generation coil GC is charged into the capacitor $C_1$, and when the stored voltage of the capacitor $C_1$ reaches a predetermined value, an induced voltage is produced in the trigger coil TC causing a trigger current to flow into the resistor $R_8$ from the diode $D_6$ through the resistor $R_7$ whereby the thyristor SCR is turned on.

When the thyristor SCR turns on, the electric charge stored in the capacitor $C_1$ is rapidly discharged into the primary winding $T_1$ through the thyristor SCR. This discharge causes a high voltage to be induced in the secondary winding $T_2$ to produce a spark discharge in plug P.

In either cause, whether using the induction discharge type ignition circuit TCI or the capacity discharge type ignition circuit CDI, ignition can be achieved by turning on the thyristor SCR. In accordance with the present invention, the on time or trigger time of the thyristor SCR is retarded from the normal firing time, electrically set by resistor $R_2$ or $R_7$ when rotational speed of the internal combustion engine exceeds a predetermined value. This spark retardation in the region of overrotation rapidly decreases output of the internal combustionengine, thereby inevitably decreasing the rotational speed of the internal combustion engine.

Thus, according to the present invention, the capacitor C connected to the gate of thyristor SCR used in the ignition circuits TCI and CDI is charged with an inverse voltage, and when rotational speed of the internal combustion engine exceeds a predetermined value, i.e., a state of overrotation, the inverse voltage stored in the capacitor C is discharged through a discharge circuit having a suitable time constant. This discharge of the capacitor C causes the gate potential of the thyristor SCR to be biased to a lower potential than that of the cathode of the thyristor SCR over a period of time, in accordance with the time constant of the discharge circuit of the capacitor C. Thus discharge disables triggering of the thyristor SCR so that the trigger time of the thyristor SCR is retarded for a period of time in accordance with the time constant of the discharge circuit of the capacitor C to thereby retard ignition timing of plug P. This retarded firing of the plug decreases overrotation and the rotational speed of the internal combustion engine.

Figure 1:
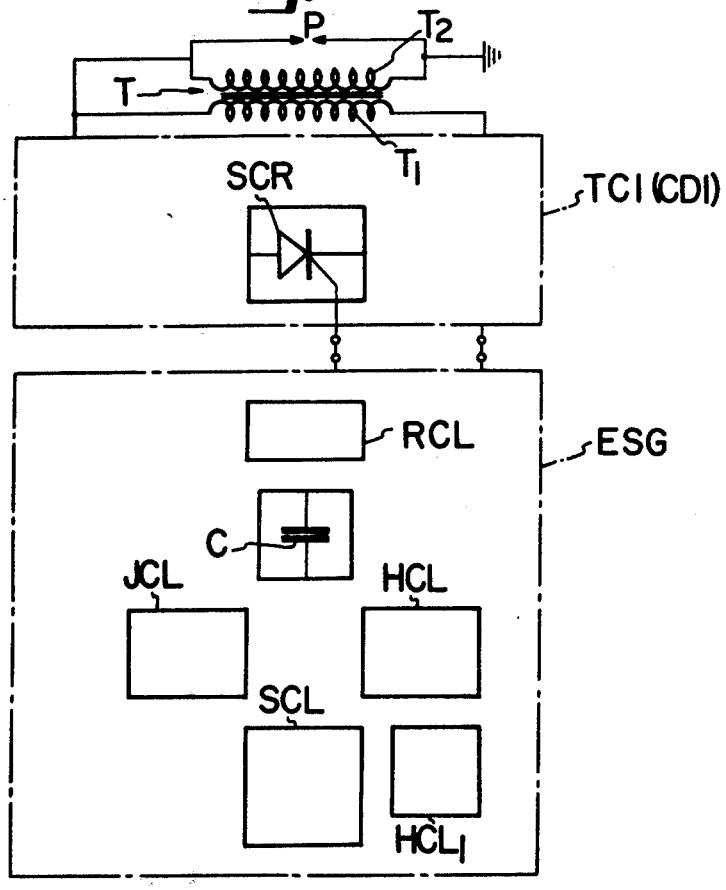
FIG. 1 is a block diagram showing a basic construction in accordance with the present invention.

Thus, in the present invention, the inverse voltage stored in the capacitor C, which is connected to the gate of the thyristor SCR used in the ignition circuits (TCI and CDI), is discharged when the internal combustion engine is in a state of overrotation to bias the gate of the thyristor SCR negatively with respect to the cathode so that the trigger time of the thyristor SCR is retarded over a period of time in accordance with the discharging time of the capacitor C to prevent overrotation of the internal combustion engine. Accordingly, an overrotation prevention circuit ESG (see FIGS. 1,2) embodying the present invention would require at least; a capacitor C of which one terminal is connected to the gate of the thyristor SCR used in the ignition circuit TCI or CDI; a charging circuit (Jcl) for charging the capacitor C with an inverse voltage; a discharging circuit (Hcl) for discharging the inverse voltage stored in the capacitor C; and a discharge switch circuit (Scl) for closing the discharging circuit (Hcl) to discharge the capacitor C when rotational speed of the internal combustion engine is in overrotation.

A basic embodiment of the circuit ESG in accordance with the present invention, which is presumably a simplest form, will be discussed with reference to FIG. 2.

In the embodiment shown in FIG. 2, an overrotation prevention circuit (ESG) is connected to the ignition circuit (TCI) described above. Inserted between the gate and cathode of the thyristor SCR is a circuit loop comprising in series a resistor $R_9$ a capacitor C, and a second thyristor $SCR_1$ having its anode connected to the capacitor, C and its cathode connected to the cathode of the thyristor SCR.

The gate circuit of the thyristor $SCR_1$ is a loop circuit comprising in series a trigger coil $TC_1$, a rectifying diode $D_{10}$ and a resistor VR. The thyristor $SCR_1$ has its gate connected to a movable contact of the resistor VR.

A rectifying diode $D_7$ is inserted between the negative terminal, i.e., lower end in FIG. 2, of the primary winding $T_1$ [also connected to the cathode of the thyristor $SCR_1$] and anode of the capacitor C. The anode is also connected to the cathode of the thyristor $SCR_1$. It should be noted that as defined herein and in FIG. 2 the anode of the capacitor C is the left terminal of the capacitor and the right terminal of the capacitor is defined as the cathode. A rectifying diode $D_8$ is inserted between the cathode of the capacitor C and positive terminal, i.e., upper end in FIG. 2, of the primary winding $T_1$ with the diode cathode connected to the positive terminal of the primary winding $T_1$. Both the diode and $D_7$ and $D_8$ form a charging circuit (JCL) for the capacitor C when an inverse voltage, that is negative at the transistor collector and positive at the emitter is induced in winding $T_1$.

Accordingly the inverse voltage induced in the primary winding $T_1$ is charged into the capacitors C. The capacitor is charged positive at its anode and negative at its cathode.

Further, a rectifying diode $D_9$ is inserted between the gate of the thyristor SCR [with resistor $R_9$ connected thereto] and the cathode of the thyristor $SCR_1$ with the anode of the diode $D_9$ connected to the cathode of the thyristor $SCR_1$. The combination of the diode $D_9$ and the resistor $R_9$ forms a portion of the discharging circuit [HCL] for the capacitor C.

This discharging circuit [HCL] forms a time constant circuit so that when the circuit comprising the capacitor C, thyristor $SCR_1$, diode $D_9$ and resistor $R_9$ is closed, the electric charge stored in the capacitor C is discharged in a period of time predetermined by the values of the capacitor C and resistor $R_9$.

With the embodiment shown in FIG. 2 constructed as above described, when the rotational speed of the internal combustion engine reaches a preselected level (set by the resistor VR), the thyristor $SCR_1$ is placed in conduction to discharge the electrical charge stored in the capacitors C. Discharge current flows from the anode (left terminal, FIG. 2) through the thyristor $SCR_1$, the diode $D_9$ and the resistor $R_9$, whereby gate potential of the thyristor SCR is decreased to the value representing the voltage drop across conducting diode $D_9$. Conduction of thyristor SCR is delayed until discharge of capacitor C is completed, that is, by the time set by the capacitor C and the resistor $R_9$. Thereby conduction of thyristor SCR is delayed (retarded) as compared to the normal firing time set by the resistors in the gate circuitry of the thyristor SCR and more particularly by the variable resistor $R_2$. Thus, above a preselected speed, spark retardation occurs to prevent overrotation of the internal combustion engine.

It should be noted that it is the setting of the variable resistor VR connected to the gate of the second thyristor $SCR_1$ which determines the speed at which retardation begins.

The operation of the aforementioned circuit will further be described in detail.

When the internal combustion engine is driven at a normal rotational speed, the gate voltage $V_2$ (see FIG. 3(*b*)) of the thyristor $SCR_1$ due to the voltage induced, e.g., from a magnetic field associated with the engine flywheel, in the trigger coil $TC_1$ does not reach the trigger voltage of the thyristor $SCR_1$. Hence, the thyristor $SCR_1$ is not placed in conduction; as a consequence the retard circuit ESG which discharges the capacitor C, is not operated but only the ignition circuit ($TC_1$) of the transistor Tr and the thyristor SCR is operated. The engine operates normally.

When the rotational speed of the internal combustion engine increases for some reason from the normal state as described above to a speed level predetermined by the setting of the resistor VR, the gate voltage ($V_2$) of the thyristor $SCR_1$, said gate voltage being due to the voltage induced in the trigger coil $TC_1$, reaches the trigger voltage (see FIG. 3) (*b*)) of the thyristor $SCR_1$ to place the thyristor $SCR_1$ in conduction.

Conduction of $SCR_1$ imposes the voltage of capacitor C on the resistor $R_9$ because of the low voltage drop across the thyristor SCR, and diode $D_9$ during conduction. Accordingly, the gate of the ignition thyristor SCR which connects to the cathode of the diode $D_9$ is at a low potential relative to its cathode and will not fire. This inhibited condition of the thyristor SCR continues while capacitor C discharges. After the capacitor C is discharged, the gate of the ignition thyristor SCR goes positive relative to its cathode and the thyristor SCR fires. Firing of the thyristor SCR as stated above, shunts the transistor (Tr) base and emitter together and interrupts emitter collector current flow causing a spark at the plug P.

In other words, the thyristor $SCR_1$ is triggered, and as a consequence, the trigger time of the thyristor SCR is delayed by the time set by the time constant circuit formed by the capacitor C and the resistor $R_9$.

When the thyristor SCR conducts, the emitter-collector current is interrupted, as a conseqence of which the voltage between the collector and the emitter of the transistor Tr is rapidly increased as shown in FIG. 3 (*a*) due to the well-known inductive kick in the primary winding $T_1$ to rapidly create a high voltage in the secondary winding $T_2$.

If the rotational speed of the internal combustion engine is greater than the speed set for firing the thyristor $SCR_1$ by the resistor VR, the protection circuit (ESG) is continuously operated to fire thyristor $SCR_1$ on every cycle. The delay time in firing thyristor SCR is fixed, set by the time constant circuit formed by the capacitor C and the resistor $R_9$irrespective of the rotational speed of the internal combustion engine. Hence, a fixed time period represents a larger portion of the engines rotation cycle when the speed of rotation is higher; the higher the rotational speed of the internal combustion engine, the greater is the magnitude of angle of lag in firing the plug P thereby increasing the overrotation prevention effect accordingly.

FIG. 4 is a graphic representation showing the experimentally determined relation between the rotational speed of an internal combustion engine and the angle of lag produced by the protection circuit (ESG). Curve I illustrates the case where the lowest rotational speed for initiating firing of the protective circuit (ESG) is set to 3,000 rpm by the resistor VR. Curve II is the case where the starting rotational speed is set to 5,000 rpm; curve III is the case where the starting rotational speed is set to 7,000 rpm; and curve IV is the case where the starting rotational speed is set to 8,000 rpm.

It will be noted that the time constant in the time constant circuit is the same in all the cases and a flywheel, mounted on the internal combustion engine, is driven by the motor. This experiment was carried out merely to see the relation between the increase in the engines rotational speed and the effect on angle of lag is produced by the circuit ESG of the invention.

As may be seen clearly in comparison of the various curves, the magnitude of lag angle is conspicuously higher when the set speed for initiating firing delay is higher in spite of the same time constant. Thus, higher setting speeds increase the rotation-reducing effect produced by angle of lag.

As is also obvius from the curves in FIG. 4, even in the same setting condition, the degrees of lag angle increase as the rotational speed increases, and the firing delay which directly acts to prevent overrotation becomes greater in proportion to the increase in rotational speed.

It will be appreciated that if the thyristor SCR is triggered prior to the operation of the switching circuit (ESG), then the firing is not delayed even when overrotation exists.Accordingly, it is necessary to set the trigger time $t_1$ of the thyristor $SCR_1$ at a time slightly earlier than the trigger time of the thyristor SCR.

Accordingly, the width of angle of lag of the trigger time of the thyristor SCR by the circuit ESG is a value slightly smaller than the time constant set by the capacitor C and the resistor $R_9$.

In the embodiment shown in FIG. 2, the trigger time of the thyristor $SCR_1$ is set by the trigger coil $TC_1$ irrespective of the value of the inverse voltage charged in the capacitor C. Separately from the embodiment shown in FIG. 2, FIG. 5 illustrates another embodiment of the invention in which the thyristor $SCR_1$ is triggered in accordance with the value of the inverse voltage charged in the capacitor C.

The embodiment shown in FIG. 5 which is similar to the circuit of FIG. 2 except for the switching circuitry (ESG) which comprises a thyristor $SCR_1$ having its cathode connected directly to the cathode of the thyristor SCR to form a discharge circuit. The anode of the thyristor $SCR_1$ is connected to one terminal of the capacitor C while the other terminal of capacitor C connects to the gate of thyristor SCR via the resistor $R_9$. A rectifying diode $D_7$ shunts the thyristor $SCR_1$ with the diode $D_7$ anode connected to the cathode of the thyristor $SCR_1$, and the diode $D_7$ cathode connected to the anode of $SCR_1$. The diode $D_8$ connects its anode at the junction between the capacitor C and resistor $R_9$; the cathode of diode $D_8$ connects to the upper positive (FIG. 5) terminal of the primary winding $T_1$. Resistor $R_{13}$ is connected between the gate and cathode of the thyristor $SCR_1$. The cathode of thyristor $SCR_1$ connects to the cathode of the thyristor SCR. The Zener diode $ZD_1$ connects between the anode and gate of the thyristor $SCR_1$ with the Zener cathode connected to the thyristor anode. Diode $D_9$ has its cathode connected to the gate of the thyristor SCR and its anode connected to the cathode of thyristor SCr. The ignition circuit, identified as TCl in FIG. 5 and connected across the primary winding $T_1$ of the ignition transformer T, is substantially identical to those circuits identified as TC1 in FIG. 2 and operates identically.

That is, the circuit shown in FIG. 5 is virtually identical in construction to that shown in FIG. 2 with the exception of the gate circuit of the thyristor $SCR_1$.

Thus, when an inverse voltage is induced in the primary winding $T_1$, that is, when the lower end (FIG. 5) of primary winding $T_1$ is positive, an inverse voltage is charged into the capacitor C, the charging current passing through the circuit (Jcl) which comprises the lower end of primary winding $T_1$, diode $D_7$, capacitor C, diode $D_8$ and back to the upper end of primary winding $T_1$.

On the other hand, the inverse voltage stored in the capacitor C is discharged by a current passing through the discharge circuit (Hcl) from the capacitor C, through thyristor $SCR_1$, diode $D_9$, resistor $R_9$, and back to the capacitor C.

Incidentally, since the inverse voltage to be stored in the capacitor C is the voltage induced in the primary winding $T_1$, it increases in proportion to the rotational speed of the internal combustion engine. Further, a series circuit comprising the Zener diode $ZD_1$ and the resistor $R_{13}$ is connected in parallel with a series circuit comprising the capacitor C, the resistor $R_9$ and the diode $D_9$. When the voltage between electrodes, positive on the left electrode, of the capacitor C, impressed across the Zener, exceeds the Zener breakdown voltage of the Zener diode $ZD_1$, the Zener diode $ZD_1$ conducts. As a result, an electric current is passed through the resistor $R_{13}$ and applies a gate voltage which triggers the thyristor $SCR_1$.

The value of the inverse voltage charged into the capacitor C in an overrotation state of the internal combustion engine can be determined beforehand whereby only when the rotational speed of the internal combustion engine is in the overrotation state, will the Zener diode $ZD_1$ breakdown and as a result, an electric current flows into the resistor $R_{13}$ to trigger the thyristor $SCR_1$.

This will be explained in accordance with the operation of the entire circuit (ESG) (FIG. 5).

When the rotational speed of the internal combustion engine is within the range of normal speeds, the inverse voltage charged into the capacitor C will not reach the Zener breakdown voltage of the Zener diode $ZD_1$ so that the circuit ESG is not operated and the thyristor SCR comes in conduction at the time $t_1$ set by the resistor $R_2$ to produce a spark discharge in plug P exactly as in the circuit of FIG. 2 described above.

Then when the rotational speed of the internal combustion engine increases for some cause or other, the inverse voltage induced in the primary winding $T_1$ also increases and the value of the voltage stored in the capacitor C also increases.

When the rotational speed of the internal combustion engine increases up to the overrotation value set previously to accommodate the Zener diode $ZD_1$, the inverse voltage stored in the capacitor C and impressed across the thyristor $SCR_1$ reaches the Zener breakdown voltage of the Zener diode $ZD_1$ and thyristor $SCR_1$ is fired to delay the spark at the plug P.

Incidentally, the breakdown of the Zener diode $ZD_1$ is not achieved at the same time when a potential difference between electrodes of the capacitor C first reaches the Zener voltage but occurs at time $t_3$ when the voltage between collector and emitter of the transistor Tr, i.e., the potential difference between terminals of the primary winding $T_1$, gradually changes from the maximum value in the inverse direction to the forward voltage, as shown in FIG. 6 (*a*).

As shown in FIG. 6 the change in voltage between anode and cathode of the thyristor $SCR_1$ for causing the Zener diode $ZD_1$ to breakdown assumes a minimum value, by forward conduction of diode $D_7$, when the inverse voltage of the primary winding $T_1$ is at maximum but an electric charge corresponding to the maximum value of the inverse voltage is charged into the capacitor C. As a consequence, the aforesaid anode to cathode voltage of $SCR_1$ increases as the inverse voltage of the primary winding $T_1$ decreases, and finally reaches the Zener voltage of the Zener diode $ZD_1$ at time $t_3$.

When the Zener diode $ZD_1$ breaks down, the trigger voltage of the thyristor $SCR_1$ is produced in the resistor $R_{13}$ to place the thyristor $SCR_1$ in conduction.

When the thyristor $SCR_1$ comes in conduction, the electric charge stored in the capacitor C passes through the thyristor $SCR_1$, the diode $D_9$ and the resistor $R_9$, and capacitor C is discharged in accordance with the time constant set by the capacitor C and the resistor $R_9$.

The discharge of the inverse voltage stored in the capacitor C, i.e., the conduction of the thyristor $SCR_1$, causes the positive electrode (left side, FIG. 5) of the capacitor C to be virtually short circuited to the gate of thyristor SCR via the diode $D_9$. As a consequence, the potential of the gate of the thyristor SCR drops to the negative side to render conduction of the thyristor SCR impossible.

This state is retained for a period of time $\Delta t_1$ set by the time constant to completely discharge the capacitor C, that is, for a period of time from $t_3$ to $t_2$.

The timing in overrotation for conduction of the thyristor $SCR_1$, i.e., breakdown time $t_3$ of the Zener diode $ZD_1$, is set at a time earlier than normal conduction of the thyristor SCR would begin without overrotation, i.e., normal ignition time $t_1$ is within the range of time $\Delta t_1$. Accordingly, the normal ignition time $t_1$ is within the period for discharging the capacitor C. However, the thyristor SCR gate is shunted by diode $D_9$ to its cathode during the discharge of the capacitor C as previously mentioned, hence, it is impossible to place the thyristor SCR in conduction.

However, near the time $t_2$ at which discharge of the capacitor C is completed, the forward voltage (FIG. 6 (*a*)) induced in the primary winding $T_1$ also increases. As a consequence, the gate potential of the thyristor SCR also rises gradually as shown in FIG. 6 (*c*) and has reached the trigger potential at time $t_2$, when discharge of the capacitor C is completed, to trigger the thyristor SCR, thus producing a spark discharge in plug P.

That is, ignition timing of the ignition circuit, indicated in FIG. 5 as TCI will delay by the time $\Delta t_2$ from time $t_1$ set by the resistor $R_2$ to time $t_2$ when discharge of the capacitor C completes.

This delay of ignition timing causes output of the internal combustion engine to decrease abruptly, thereby decreasing the rotational speed thereof.

In the ESG circuit, therefore, the Zener breakdown voltage of the Zener diode $ZD_1$ may suitably be set (a Zener diode $ZD_1$ having a suitable value of Zener voltage may be selected), whereby the rotational speed of the internal combustion engine for operating the switching circuit (ESG) may suitably be set. The value of angle of lag of ignition timing may freely be set by adjusting the time constant of the RC time constant circuit.

When for some cause of other, the rotational speed of the internal combustion engine tends to remain excessive in spite of the fact that the switch circuit (ESG) is operating, the amount of electric charge stored in the capacitor C on the inverse voltage cycle increases and the time $\Delta t_1$ increases. The amount of rotation of the flywheel per unit time increases for a given time delay. Thereby angle of lag which acts directly to reduce rotational speed of the internal combustion engine is greater as rotational speed is greater.

It will be appreciated that the switching circuit (ESG) affords the added advantage of prespark prevention since an inverse current flows in the primary winding $T_1$ when an inverse voltage is induced in the primary winding $T_1$. The same is true for the embodiment shown in FIG. 2.

Next, FIGS. 7 and 8 illustrate embodiments proposed in an effort to overcome inconveniences encountered in the embodiments shown in FIGS. 2 and 5. In the embodiments shown in FIGS. 2 and 5, there involves the disadvantages such that the charging voltage to the capacitor C cannot be regulated by the primary winding $T_1$, and that when the internal combustion engine runs in normal condition, the inverse voltage charged in the capacitor C remains charged to slightly drop the gate potential of the thyristor SCR through the resistor $R_9$, resulting in a slight delay of the normal ignition time $t_1$.

The embodiments illustrated in FIGS. 7 and 8 have been proposed in an effort to overcome the aforementioned disadvantages encountered in the embodiments illustrated in FIGS. 2 and 5.

It will be noted that in the ignition circuit TCI shown in FIGS. 7 and 8, a series circuit comprising a diode $D_2$ inserted between base and emitter of a transistor Tr and a resistor $R_6$ is the premature ignition prevention circuit in the ignition circuit TCI.

The overrotation prevention circuit ESG in the embodiment shown in FIG. 7 comprises a thyristor $SCR_1$ having cathode connected to cathode of thyristor SCR to form a discharge switch circuit Sc1, the thyristor $SCR_1$ having anode connected to gate of the thyristor SCR through capacitor C and a diode circuit $D_9'$ in the form of a resistance circuit Rc1 composed of a plurality of diodes (two diodes in the illustrated embodiment) forward connected in series, a rectifying diode $D_7$ inserted between the negative terminal of primary winding $T_1$ with the cathode of thyristor $SCR_1$ connected thereto and anode side of capacitor C connected to the anode of the primary winding $T_1$ with the anode connected to the cathode of thyristor $SCR_1$, a series circuit comprising a resistor $R_{10}$ in the form of a variable resistor and a rectifying diode $D_8$ with cathode connected to the positive terminal of the primary winding $T_1$ inserted between the cathode of the capacitor C and the positive terminal of the primary winding $T_1$ to form a charging circuit Jc1, a resistor $R_{11}$ forming a discharging circuit Hc1 inserted between the cathode of thyristor $SCR_1$ and the cathode side of capacitor C, a resistor $R_{12}$ connected in parallel with the capacitor C to form a second discharging circuit Hc1, a resistor $R_{13}$ inserted between gate and cathode of thyristor $SCR_1$ and connected in parallel with a capacitor $C_2$, a rectifying diode $D_{10}$ inserted between anode and gate of thyristor $SCR_1$ with the anode connected to anode of thyristor $SCR_1$, and a resistor $R_{14}$ connected in series to the diode $D_{10}$ to form an integrating circuit in the gate circuit of the thyristor $SCR_1$.

It will of course be understood that the diode circuit $D'_9$ in the form of a resistance circuit Rcl has its anode connected to the capacitor C.

Incidentally, the diode circuit $D'_9$ in the form of a resistance circuit Rcl inserted between the capacitor C and the gate of thyristor SCR is provided so that when one electrode of the capacitor C is short-circuited to emitter of the transistor Tr through the thyristor $SCR_1$, the other electrode of the capacitor C is placed substantially in short-circuit relation with the gate of thyristor SCR, whereas in the state where the thyristor $SCR_1$ is not placed in conduction, the electric charge charged in the capacitor C will not exert the electric action upon the gate of the thyristor SCR. The diode circuit $D'_9$ is advantageously designed so that two diodes are connected in series with anode side thereof connected to gate of the thyristor SCR, as illustrated in FIG. 7.

That is, assuming that the resistance circuit Rc1 is the pure resistor as shown in the embodiments of FIGS. 2 and 5, the gate of thyristor SCR is connected to the cathode by the resistance circuit Rc1, and as a consequence, the trigger voltage of the thyristor SCR specifically set by the diode $D_1$ and the resistor $R_4$ is disordered and in addition, the negative potential on the cathode side of the capacitor C with the gate of thyristor SCR connected through the resistance circuit Rc1 is biased toward the emitter of transistor Tr by a minute current-leakage passing through the diode $D_7$ and the resistor $R_{11}$ irrespective of operation and non-operation of the thyristor $SCR_1$, whereby the negative potential on the cathode side of the capacitor C directly influences upon the gate of thyristor SCR through the resistance circuit Rcl to delay the ignition timing of thyristor SCR.

On the other hand, if the resistance circuit Rc1 is designed so that two diodes are connected in series as shown in the embodiment of FIG. 7, a series circuit between the series circuit comprised of the diode $D_1$ and the resistor $R_4$ and the resistance circuit Rc1 in the form of the parallel connection will not at all influence upon triggering of the thyristor SCR in accordance with the diode characteristic at the time of normal rotational speed, and voltage drop in resistor $R_{11}$ resulted from a minute current-leakage due to the electric charge charged in the capacitor C is smaller than both the diode characteristic voltages in the resistance circuit Rc1 so that the electric charge charged in the capacitor C will not influence upon the gate of the thyristor SCR.

As described above, the resistance circuit Rc1 comprises two diodes connected in series. The use of two diodes is made because there is one diode $D_1$ inserted between gate and cathode of the thyristor SCR. However, it will of course be understood that the resistance circuit Rc1 may comprise more than two diodes connected in series according to the value of resistor $R_{11}$ or may comprise a Zener diode.

In the case of the embodiment shown in FIG. 7, a series circuit comprising the diode $D_{10}$ with anode connected to the anode of thyristor $SCR_1$ and the resistor $R_{14}$ is inserted between anode and gate of the thyristor $SCR_1$, and capacitor $C_2$ is inserted between gate and cathode of the thyristor $SCR_1$ so that the resistor $R_{14}$ and the capacitor $C_2$ constitute an integrating circuit, which is the safety circuit for preventing a latching miss from produced in the thyristor SCR in the ignition circuit TCI resulted from malfunction of the overrotation prevention circuit ESG caused by an electric impact from the ignition circuit TCI at the time of normal rotational speed.

That is, in a state where rotational speed is high within the range of normal rotational speed, a potential to be charged in the capacitor C assumes a value slightly smaller than that of potential required to trigger the thyristor $SCR_1$ and such a small value retained. However, when the electric shock from the ignition circuit TCI caused by triggering of the thyristor SCR or the like is applied to the capacitor C in a state as described to momentarily increase the potential of the capacitor to a high level such that the thyristor $SCR_1$ may be triggered, the thyristor $SCR_1$ is placed in a conduction state to induce a latching miss in which the thyristor SCR cut off by conduction of the thyristor $SCR_1$ is again placed in conduction after a lapse of a given period of time, which will be further described in later.

This electric shock from the ignition circuit TCI to the overrotation prevention circuit ESG is mostly caused by the triggering operation of the thyristor SCR, or by the pulse wave having the width of extremely short period of time such as 100 μsec. without exception.

Accordingly, if integral constant of the integrating circuit comprised of the resistor $R_{14}$ and the capacitor $C_2$ is set to a value far greater than 100 μsec., the electric shock from the ignition circuit TCI to the capacitor C is entirely absorbed into the capacitor $C_2$ and triggering of thyristor $SCR_1$ caused by the electric shock from the ignition circuit TCI or malfunction of the overrotation prevention circuit ESG can be avoided completely.

The resistor $R_{12}$, which is connected in parallel with the capacitor C, forms a second discharging circuit $Hcl_2$ of the capacitor C which attenuates the electric charge charged in the capacitor C at a desired speed.

That is, if the electric charge charged in the capacitor C permanently maintains a given value, there is an increased chance to produce malfunction of the overrotation prevention circuit ESG caused by the electric shock from the ignition circuit TCI. Accordingly, it is suggested that the electric shock charged in the capacitor C is discharged to some extent at the time when the thyristor SCR is triggered, and even if the voltage of the capacitor C should be increased by the electric shock from the ignition circuit TCI, the thus increased voltage is not in excess of the trigger voltage of the thyristor $SCR_1$.

It will of course be noted that the value of the resistor $R_{12}$ forming the second discharging circuit $Hcl_2$ of the capacitor C when the overrotation prevention circuit ESG is not operated is far greater than the value of the resistor $R_{11}$ forming the discharging circuit Hcl of the capacitor C when the overrotation prevention circuit ESG is operated as a result of triggering the thyristor $SCR_1$.

The overrotation prevention circuit ESG constructed as described above and shown in FIG. 7 operates in a manner substantially similar to that of the circuit ESG shown in the embodiments of FIGS. 2 and 5, which is as follows:

The capacitor C is charged when an inverse voltage is produced in the primary winding $T_1$. When an inverse voltage is produced in the primary winding $T_1$, the capacitor C is charged with the electrode on the side of diode $D_7$ indicative of positive while the electrode on the side of resistor $R_{10}$ indicative of negative, through a circuit comprising the primary winding $T_1$, the diode $D_7$, the capacitor C, the resistor $R_{10}$, and the diode $D_8$ to the primary winding $T_1$.

The amount of charge of the capacitor C is determined by the resistance ratio between resistors $R_{10}$ and $R_{11}$, that is, by the resistor $R_{10}$ in the form of a variable resistor.

Since the amount of charge of the capacitor C is not sufficient to trigger the thyristor $SCR_1$ when the rotational speed of the internal combustion engine is within the range of normal rotational speed, substantial operation of the overrotation prevention circuit ESG will not be effected.

Accordingly, the thyristor SCR in the ignition circuit TCI is triggered at the normal ignition time set by the resistor $R_2$.

It will be noted that during the normal operation of the ignition circuit TCI, the electric charge charged in the capacitor C is discharged mostly passing through the resistor $R_{12}$ and partly passing through the diode $D_{10}$, resistors $R_{14}$ and $R_{13}$.

When the rotational speed of the internal combustion engine is increased for some cause or the other from a level as described to the overrotation speed set by the resistor $R_{10}$, the amount of charge of the capacitor reaches the value sufficient to trigger the thyristor $SCR_1$.

Accordingly, a forward voltage is induced in the primary winding $T_1$ and when the voltage increases, a potential of anode of the thyristor $SCR_1$ increases relative to cathode of the thyristor $SCR_1$. When this potential becomes greater than the forward voltage of the diode $D_{10}$, an electric current is passed into the resistor $R_{13}$ through the diode $D_{10}$ and the resistor $R_{14}$ to produce a voltage in gate of the thyristor $SCR_1$ sufficient to trigger thereof, thus triggering the thyristor $SCR_1$.

When the thyristor $SCR_1$ is turned on, the potential of the anode side of the capacitor C is dropped to the emitter potential of the transistor Tr, and as a consequence, the cathode side of the capacitor C is negatively biased with respect to the emitter of the transistor Tr.

When the cathode side of the capacitor C is negatively biased as described above, the gate of the thyristor SCR is also negatively biased through the resistance circuit Rcl, which state is kept by the time of time constant set by the capacitor C and the resistor $R_{11}$ or by the discharge time of the capacitor C.

After the time constant which completes the discharge of the capacitor C, the gate potential of the thyristor SCR gradually increases to the trigger potential to trigger the thyristor SCR thereby producing a spark discharge in plug P.

That is, the trigger time of the thyristor (which is the same as the ignition time of the ignition circuit TCI) is delayed by the time corresponding to the time constant set by the capacitor C and the resistor $R_{11}$ similarly to the embodiments shown in FIGS. 2 and 5.

FIG. 8 illustrates another embodiment of a circuit structure further simplified from those shown in FIGS. 2, 5 and 7. The circuit shown in FIG. 8 comprises a thyristor $SCR_1$ forming a discharge switch circuit Scl with cathode thereof connected to the cathode of thyristor SCR, the thyristor SCR, having its anode connected to gate of the thyristor SCR through capacitor C and diode $D_1$ forming a gate circuit of the thyristor SCR, a diode $D_7$ inserted between the negative terminal of primary winding $T_1$ and the anode side of the capacitor C with cathode thereof connected to the capacitor C, a series circuit comprising a resistor $R_{10}$ in the form of a variable resistor and a diode $D_8$ with cathode thereof connected to the positive terminal of the primary winding $T_1$ inserted between the cathode side of the capacitor C and the positive terminal of the primary winding $T_1$ to form a charging circuit Jcl, and a resistor $R_{12}$ forming a second discharging circuit $Hcl_2$ connected in parallel with the capacitor C.

It will be noted that the trigger circuit of the thyristor $SCR_1$ comprises a resistor $R_{13}$ inserted between cathode and gate of the thyristor $SCR_1$ and a Zener diode $ZD_1$ inserted between anode and gate thereof, similarly to the embodiment shown in FIG. 5.

As is apparent from the construction as described above, the circuit ESG shown in FIG. 8 uses the diode $D_1$ for temperature compensation of the thyristor SCR as a resistance circuit Rcl, and the resistor $R_4$, which is the gate resistor of the thyristor SCR, as a discharging circuit Hcl, thereby simplifying the circuit.

The operation of the circuit ESG shown in FIG. 8 is basically identical to that shown in FIG. 5, but the value of an inverse voltage charged in the capacitor C is set by the resistor $R_{10}$ similarly to the embodiment shown in FIG. 7.

This resistor $R_{10}$ not only sets the voltage charged in the capacitor C but also sets the rotational speed of the internal combustion engine in which the circuit ESG is operated.

That is, the operation of the circuit ESG is effected by triggering the thyristor $SCR_1$ resulted from the breakdown of the Zener diode $ZD_1$. Accordingly, the Zener diode $ZD_1$ whose Zener voltage is slightly smaller than the voltage charged in the capacitor C when the rotational speed of the internal combustion engine is in overrotation may be used to set the rotational speed of the internal combustion engine in which the circuit ESG is operated. However, this arrangement poses various disadvantages such that it is extremely cumbersome in terms of circuit structure to pick out the Zener diode $ZD_1$ having a desired Zener voltage suitable for the voltage charged in the capacitor C when the internal combustion engine is in overrotation, that it is utterly impossible to change the overrotational speed of the internal combustion engine to be set to lose the flexibility as the circuit, and that a number of standardized circuits ESG cannot be obtained. In order to overcome the disadvantages noted above, the value of the resistor $R_{10}$ may be varied to adjust the voltage charged in the capacitor when the internal combustion engine is in overrotation to the Zener voltage of the Zener $ZD_1$, thereby obtaining various merits such that overrotational speed of the internal combustion engine at which the circuit ESG commences its operation may freely be set and that the Zener diode $ZD_1$ used may be widened in range.

The inverse voltage charged in the capacitor C is at time (a) at which the inverse voltage developed across the terminals of the primary winding $T_1$ (as shown by hatching in FIG. 9) is maximum, as shown in FIG. 9. However, when the rotational speed of the internal combustion engine is in overrotation, the thyristor $SCR_1$ is triggered at time (b) at which the voltage in the forward direction of the primary winding $T_1$ is started to be raised, instead of the time (a), similarly to the case of the embodiment shown in FIG. 5.

It will of course be understood that the time (b) is the time earlier than the normal ignition time $t_1$ when the internal combustion engine is driven in normal condition.

FIGS. 10, 13 and 14 illustrate embodiments in which charging of the capacitor C is accomplished by ignition coil T in a manner similar to the above-mentioned embodiments, with the exception that a discharge switch circuit Scl comprises a Zener diode ZD.

Referring now to FIG. 10 illustrating a circuit ESG in which a discharge circuit Scl comprises a Zener diode ZD in place of the discharge switch circuit Scl formed by the thyristor $SCR_1$ in the embodiment illustrated in FIG. 8. The circuit ESG comprises the Zener diode ZD forming the discharge switch circuit Scl having anode connected to the negative terminal of the primary winding $T_1$ to which cathode of thyristor SCR is connected, the Zener diode ZD having cathode connected to gate of the thyristor SCR through capacitor C and diode $D_1$, a rectifying diode $D_7$ inserted between negative terminal of the primary winding $T_1$ and anode of the capacitor C with the cathode connected to the anode of the capacitor C, a series circuit comprising a resistor $R_{10}$ and a diode $D_8$ with cathode connected to the positive terminal of the primary winding $T_1$ inserted between the cathode of the capacitor C and the positive terminal of the primary winding $T_1$ to form a charging circuit Jcl, and a resistor $R_{12}$ forming a second discharging circuit $Hcl_2$ connected in parallel with the capacitor C.

As will be evident from the above-mentioned construction, the circuit ESG shown in FIG. 10 merely employs the Zener diode ZD in place of the discharge switch circuit Scl formed by the thyristor $SCR_1$ in the embodiment of FIG. 8, and the basic operation of the circuit ESG is substantially the same as that of the embodiment shown in FIG. 8.

The operation of the circuit ESG shown in FIG. 10 will now be described with reference to the diagrams of FIGS. 11 and 12.

FIG. 11 is a diagram when the internal combustion engine is driven in normal condition, that is, when the circuit ESG is not in operation, and FIG. 12 is a diagram when the circuit ESG is in operation, where (v) indicates the voltage between the terminals of the primary winding $T_1$, and ($v_3$) indicates the voltage between anode and cathode of the Zener diode ZD.

The inverse voltage charged in the capacitor C is maximum at time $t_3$ at which the inverse voltage induced in the primary winding $T_1$ is not present. However, the value of the voltage charged in the capacitor C is determined by the ratio of resistor $R_{10}$ to resistor $R_4$, after all, by the resistor $R_{10}$, as previously mentioned in the embodiment shown in FIG. 8.

Setting now that the value of resistor $R_{10}$ to resistor $R_4$ is adjusted so that when the rotational speed of the internal combustion engine reaches the overrotational speed, the maximum of the voltage value charged in the capacitor C reaches the Zener voltage of the Zener diode ZD, the charged voltage of the capacitor C due to the inverse voltage induced in the primary winding $T_1$ does not reach the Zener voltage of the Zener diode ZD, as shown in FIG. 11 (a), when the rotational speed of the internal combustion engine is in the range less than the overrotational speed, and hence, the Zener diode ZD will not be placed in conduction, and for this reason, the thyristor SCR in the ignition circuit TCI is properly operated without being affected by the overrotation prevention circuit ESG to produce a spark discharge at the normal ignition timing $t_1$.

In this state, the electric charge charged in the capactor C is gradually discharged through the resistor $R_{12}$.

When the rotational speed of the internal combustion engine is increased into overrotational speed for some cause or other, the inverse voltage charged in the capacitor C increases in value so that the inverse voltage charged in the capacitor C reaches the Zener voltage of the Zener diode ZD, and as a consequence, the Zener diode is broken down to cause the inverse voltage charged in the capacitor C to be discharged through a discharging circuit comprising the capacitor, the Zener diode ZD, the resistor $R_4$, and the capacitor C.

When the discharging circuit is formed, the gate of the thyristor SCR is negatively biased relative to the cathode of the thyristor SCR so that the thyristor SCR assumes a state not triggered.

Since this state is maintained during the time of discharging electric charge of the capacitor C, that is, during the time corresponding to the time determined by the time constant of the capacitor and the resistor $R_4$, the ignition timing of the ignition circuit TCI is delayed by that time. This time lag of ignition causes a considerable decrease in rotational speed and output of the internal combustion engine.

That is, as shown in FIG. 12, assuming that the capacitor C is started to be discharged at time $t_3$ and completed to be discharged at time $t_2$, ignition timing of the ignition circuit TCI will be delayed from the time $t_1$ to $t_2$.

The greater the electric charge charged in the capacitor C, the greater will be the lag width of ignition timing of the ignition circuit TCI caused by the discharge of the electric charge charged in the capacitor C, and the greater the overrotation, the greater will be the quantity of electric charge charged in the capacitor C, and accordingly, the force for preventing the overrotation will be exerted in proportion to the degree of overrotation of the internal combustion engine.

Thus, in accordance with the circuit ESG shown in FIG. 10, the discharge switch circuit Scl may comprise a single Zener diode ZD without requiring a specific gate circuit and costly thyristor $SCR_1$, and therefore, the circuit may greatly be simplified and the stabilized operation may be secured since there is no possible change in operating characteristic due to the temperature characteristics.

In the embodiments shown in FIGS. 13 and 14, charging of an inverse voltage in the capacitor C is achieved by the primary winding $T_1$ and the discharge switch circuit Scl comprises a Zener diode ZD, similarly to the embodiment shown in FIG. 10 but different from that of FIG. 10 in that the Zener diode ZD forming the discharge switch circuit Scl is inserted without modification between the capacitor C and gate of the thyristor SCR so as to also serve as the resistance circuit Rcl, the circuit ESG in FIG. 13 being the basic type thereof and that in FIG. 13 being the improved type thereof.

The circuit ESG shown in FIG. 13 comprises a series circuit comprising a capacitor C and a Zener diode ZD with cathode thereof connected to gate of thyristor SCR inserted between gate and cathode of the thyristor SCR, a diode $D_8$ inserted between anode of the Zener diode ZD or the cathode of capacitor C and the positive terminal of primary winding $T_1$ with cathode thereof connected to the positive terminal of the primary winding $T_1$ to form a charging circuit Jcl, and a resistor $R_{12}$ (which is preferably in the form of a variable resistor in the basic circuit shown in FIG. 13) forming a second discharging circuit $Hcl_2$ connected in parallel with the capacitor C.

In accordance with the improved circuit shown in FIG. 14, a series circuit comprising a resistor $R'_{10}$ and a diode $D_7$ with anode thereof connected to the cathode of capacitor C is connected in parallel with the capacitor C in the basic circuit shown in FIG. 13, and a resistor $R_{10}$ in the form of a variable resistor is connected in series with a diode $D_8$.

It should be noted that in the improved circuit shown in FIG. 14, the resistor $R_{12}$ can be a fixed resistor.

That is, in the case of the basic circuit shown in FIG. 13, the charging circuit Jcl is formed by the diode $D_8$; but the voltage charged in the capacitor C is set by the resistor $R_{12}$.

Accordingly, the resistor $R_{12}$ forming the second discharging circuit $Hcl_2$ also functions as the resistor $R_{10}$ in the charging circuit Jcl in the above-mentioned various embodiments.

On the other hand, in the case of the improved circuit shown in FIG. 14, the resistor $R_{12}$ is exclusively used for the second discharging circuit $Hcl_2$, and the voltage charged in the capacitor C may be set by the ratio between the resistors $R_{10}$ and $R'_{10}$, that is, by the resistor $R_{10}$ in the form of a variable resistor.

Accordingly, in the improved circuit, the voltage charged in the capacitor C is not limited because of the resistor $R_{12}$ forming the second discharging circuit $Hcl_2$, or it is not necessary to strictly select the limited rated Zener diode ZD, as is so required in the basic circuit shown in FIG. 13.

In both the circuits ESG in FIGS. 13 and 14, the discharging circuit Hc1 comprises resistors $R_2$ and $R_3$ in the ignition circuit TCI.

In operation of the basic circuit shown in FIG. 13, as is apparent from the construction thereof, when the rotational speed of the internal combustion engine is in the range less than the value set by the resistor $R_{12}$, the value of the inverse voltage induced in the primary winding $T_1$, which is charged in the capacitor C by a closed circuit comprising the primary winding $T_1$, the capacitor C, the diode $D_8$, and the primary winding $T_1$, does not reach the Zener voltage ZV of the Zener diode ZD (see FIG. 15 (*a*) so that the overrotation prevention circuit ESG is not operated, and hence, the ignition circuit TCI takes place ignition at the normal time $t_1$.

When the voltage charged in the capacitor C exceeds the Zener voltage ZV due to an increase in the inverse voltage indiduced in the primary winding $T_1$ resulted from an increase in rotational speed of the internal combustion engine, the Zener diode ZD is broken down to cause a voltage portion $\Delta V'$ exceeded from the Zener voltage ZV of the voltage charged in the capacitor C to be discharged through a discharging circuit comprising the capacitor C, the primary winding $T_1$, the resistor $R_2$, the resistor $R_3$, the Zener diode ZD, and the capacitor C, thereby negatively bias the gate of thyristor SCR relative to the cathode thereof.

For this reason, the thyristor SCR cannot be triggered during the discharging period of the aforesaid voltage portion $\Delta V'$ but it is triggered at time $t_2$ at which the gate reaches the trigger voltage after completion of the discharge of the voltage portion $\Delta V'$.

That is, ignition timing of the internal combustion engine is delayed in angle from time $t_1$ to $t_2$ by the action of the overrotation prevention circuit ESG.

Further, the improved circuit shown in FIG. 14 is basically identical to that shown in FIG. 13. That is, a voltage induced in the primary winding $T_1$ is charged in the capacitor C by a charging circuit comprising the primary winding $T_1$, the capacitor C, the diode $D_7$, the resistor $R_{10}$, the diode $D_8$, and the primary winding $T_1$, and when the rotational speed of the internal combustion engine is increased into a overrotation region to be set, the voltage charged in the capacitor C exceeds the Zener voltage ZV and a voltage portion $\Delta V'$ exceeded from the Zener voltage ZV is discharged by a discharging circuit comprising the capacitor C, the primary winding $T_1$, the resistor $R_2$, the resistor $R_3$, the Zener diode ZD, and the capacitor C to negatively bias the gate of the thyristor SCR relative to the cathode thereof, whereby ignition timing of the thyristor SCR is delayed from time $t_1$ to $t_2$ in a manner similar to that shown in FIG. 13.

The lag width of ignition timing in the ignition circuit TCI caused by the operation of the above-mentioned overrotation prevention circuit ESG is determined by the rotational speed of the internal combustion engine, that is, the voltage portion $\Delta V$ in proportion to the degree of overrotation of the internal combustion engine and circuit constant of the discharging circuit, namely, $C.(R_2+R_3)$ and $C.R_{12}$.

Since the circuit constant (discharge constant) of the discharging circuit Hc1 determines an angle $\theta$ of a gate voltage waveform (b) in FIG. 16, this angle $\theta$ may be varied to suitably vary a lead $\theta'$ of angle of lag to rates of rotation shown in FIG. 17.

That is, a degree of angle of lag in the same voltage portion $\Delta V'$ may be set freely.

In accordance with the overrotation prevention circuit ESG of the present invention, the rotational speed of the internal combustion engine, which commences the operation of angle of lag, may be set freely by the voltage charged in the capacitor C varied in proportion to the rotational speed of the internal combustion engine and the Zener voltage ZV of the Zener diode ZD, and the degree of angle of lag may be set freely by varying the resistors $R_2$ and $R_{12}$.

Incidentally, in the basic circuit shown in FIG. 13, setting of the rotational speed of the internal combustion engine to commence the operation of the overrotation prevention circuit ESG must be made by varying the Zener voltage ZV of the Zener diode ZD. This means that the Zener diode ZD be replaced.

In the case of the circuit shown in FIG. 13, therefore, conversion of rotational speed to commence the operation of angle of lag is cumbersome.

Since the resistor $R_2$ in the ignition circuit TCI is the adjustable resistor for setting trigger timing of the thyristor SCR, the value of resistance thereof is not always set to a value suitable for the overrotation prevention circuit ESG, and accordingly, in the circuit shown in FIG. 13, the resistor $R_{12}$ in the form of a variable resistor is employed to correct the angle $\theta$ to a given value. However, the resistor $R_{12}$ also influences on setting of rotational speed to commence the operation of angle of lag so that adjustment of the angle $\theta$ by the resistor $R_{12}$ is considerably restricted.

The improved circuit shown in FIG. 14 overcomes the limitations noted above with respect to the circuit shown in FIG. 13 by the provision of the resistor $R'_{10}$ connected in parallel with the capacitor C and the resistor $R_{10}$ inserted between the capacitor C and collector of transistor Tr.

That is, since the value of the inverse voltage charged in the capacitor C is determined by the ratio of resistor $R_{10}$ to resistor $R'_{10}$, the value of the voltage charged in the capacitor C in proportion to the rotational speed of the internal combustion engine may be adjusted suitably for the Zener voltage ZV, using the resistor $R_{11}$ in the form of a variable resistor, to thereby freely set the rotational speed to commence the operation of overrotation prevention without replacing the Zener diode ZD.

Since the resistor $R_{12}$ will not at all influence on setting of rotational speed to commence overrotation prevention, the value thereof may be locked to a desired value if the value of the resistor $R_2$ is once determined.

It will be noted that the diode $D_7$ in the circuit shown in FIG. 14 is provided to prevent a discharging circuit passing the resistor $R'_{10}$ from being formed at the time of discharging operation of the capacitor C resulted from breakdown of the Zener diode ZD.

Thus, in the circuits ESG shown in FIGS. 13 and 14, the Zener diode ZD forming the discharge switch circuit Scl is utilized as the resistance circuit Rcl without modification so that the inverse voltage charged in the capacitor C will not at all influence electrically on the gate of the thyristor SCR to secure the stabilized operation.

FIGS. 18–20 and FIGS. 23–25 illustrate preferred embodiments in which the circuit of the invention is applied to a capacity discharge type ignition circuit CDI, wherein FIGS. 18–20 illustrate embodiments in which charging of an inverse voltage in the capacitor C is achieved by an inverse voltage induced in a generation coil GC, while FIGS. 23–25 illustrate embodiments in which charging of an inverse voltage in the capacitor C is achieved by an inverse voltage induced in a trigger coil TC.

The construction and operation of the capacity discharge type ignition circuit CDI embodying the present invention will now be described briefly by way of an embodiment.

The ignition circuit CDI comprises a series circuit comprising a reverse current blocking diode $D_5$, a capacitor $C_1$, and a primary winding $T_1$ of an ignition coil T with a plug P connected to a secondary winding $T_2$ inserted between terminals of a generation coil GC, a thyristor SCR, whose anode is connected to the capacitor $C_1$, connected in parallel with a series circuit comprising the capacitor $C_1$ and the primary winding $T_1$, and a trigger coil TC for triggering the thyristor SCR, a diode $D_6$, a resistor $R_7$ in the form of a variable resistor for setting trigger timing of the thyristor SCR and a resistor $R_8$ in the form of a gate resistor inserted between gate and cathode of the thyristor SCR.

According to this ignition circuit CDI, when a flywheel (not shown) with a permanent magnet embedded therein is rotated to induce a voltage in the generation coil GC, an electric charge is charged in the capacitor $C_1$ through the diode $D_7$ as the induced voltage generates.

When the electric charge charged in the capacitor $C_1$ reaches a desired value, a voltage is induced in the trigger coil TC and set by the diode $D_6$ and the resistor $R_7$, and the value of the voltage of a trigger pulse applied to the resistor $R_8$ reaches the trigger voltage of the tyristor SCR to trigger the thyristor SCR.

When the thyristor SCR is triggered, the electric charge charged in the capacitor $C_1$ is discharged into the primary winding $T_1$ of the ignition coil T through the thyristor SCR. When the capacitor $C_1$ is discharged, a high voltage is induced in the secondary winding $T_2$ of the ignition coil T to produce a spark discharge in plug P, that is, ignition occurs.

The overrotation prevention circuit ESG in accordance with the present invention forms a part of a gate circuit of the thyristor SCR in the ignition circuit CDI as previously described. That is, the inverse voltage induced in the trigger coil TC or generation coil GC is charged in the capacitor C, and when the rotational speed of the internal combustion engine exceeds the set value, the capacitor is discharged to negatively bias the gate of the thyristor SCR relative to the cathode thereof thereby disabling triggering of the thyristor SCR for a period of time in accordance with the discharging time of the capacitor C to delay ignition timing of the internal combustion engine, thus preventing overrotation of the internal combustion engine, which operating principle is entirely same as that of the embodiments in the circuit TCI as previously mentioned.

That is, fundamentally, the capacitor C connected to the trigger coil TC or generation coil GC through the charging circuit is connected between gate and cathode of the thyristor SCR through the discharging circuit.

The circuit shown in FIGS. 18 and 23, which is a simplest form, comprises a series circuit comprising a capacitor C and a diode $D_8$ inserted between the terminals of trigger coil TC or generation coil GC to form a charging circuit Jcl, said capacitor C having a positive electrode connected to the terminal of trigger coil TC or generation coil GC, that is, to the negative terminal of trigger coil TC or generation coil GC connected to the cathode of a thyristor SCR, said diode $D_8$ having its cathode connected to the terminal of trigger coil TC or generation coil GC not connected to the cathode of the thyristor SCR, and a Zener diode ZD forming a discharge switch circuit Scl inserted between the negative electrode of the capacitor C and the gate of the thyristor SCR with the cathode connected to the gate of the thyristor SCR.

In the embodiments shown in FIGS. 19, 20, 24 and 25, the resistor $R_{12}$ connected in parallel with the capacitor C forms a second discharging circuit $Hcl_2$ for discharging an electric charge charged in the capacitor C when the overrotation prevention circuit ESG is not in operation, that is, when the rotational speed of the internal combustion engine is in the range not in excess of the set value.

It will be noted that the discharging circuit Hcl comprises a resistor $R_8$.

In the circuit shown in FIGS. 18 and 23, when an inverse voltage is induced in the trigger coil TC or the generation coil GC, an electric charge is charged in the capacitor C through the capacitor C and diode $D_8$.

When the voltage charged in the capacitor C is lower than the Zener voltage of the Zener diode ZD, the discharging circuit is not formed and the ignition circuit CDI produces ignition at the normal ignition time, that is, the thyristor SCR is triggered at the normal time. However, as the rotational speed of the internal combustion engine increases, the voltage charged in the capacitor C increases and exceeds the Zener voltage of the Zener diode, whereby the Zener diode ZD is broken down to form a discharging circuit comprising the capacitor C, the resistor $R_8$, the Zener diode ZD, and the capacitor C, causing the electric charge charged in the capacitor C to be discharged.

Since the gate of the thyristor SCR is negatively biased relative to the cathode thereof by the discharge through the resistor $R_8$ as described, the thyristor SCR cannot be triggered. This non-triggering condition is maintained for a period of discharging time of the capacitor C for negatively biasing the gate of the thyristor SCR, that is, for a period of time in accordance with time constant of the capacitor C and the resistor $R_8$ to thereby delay the ignition timing of thyristor SCR, that is, ignition timing of ignition circuit CDI.

Thus, in the embodiments shown in FIGS. 18 and 23, at the time when the voltage charged in the capacitor C reaches the Zener voltage of the Zener diode ZD, the operation of angle of lag is commenced, and accordingly, setting of rotational speed of the internal combustion engine to operate the overrotation prevention circuit ESG is achieved by the Zener diode ZD.

For this reason, in the case of the embodiments shown in FIGS. 18 and 23, the Zener diode ZD itself must be replaced in order to change rotational speed to commence operation of the overrotation prevention circuit ESG.

In the embodiments shown in FIGS. 19 and 24, a resistor $R_{10}$ is added to the overrotation prevention circuit ESG shown in FIGS. 18 and 23 so that operation starting speed may freely be set by the value of the resistor $R_{10}$. The circuit shown in FIGS. 19 and 24 comprises a reverse-current blocking diode $D_7$ inserted between the capacitor C of the charging circuit Jcl in the embodiments shown in FIGS. 18 and 23 and the diode $D_8$, a resistor $R_{10}$ in the form of a variable resistor inserted between the diode $D_8$ and the positive terminal of the trigger coil TC (in the case of embodiment shown in FIG. 24) or the generation coil GC (in the case of embodiment shown in FIG. 19), and a resistor $R'_{10}$ inserted between node to diode $D_7$, that is, cathode of the diode $D_7$ or anode of the diode $D_8$ and positive electrode of the capacitor C.

That is, in the case of the embodiments shown in FIGS. 19 and 24, the value of the inverse voltage charged in the capacitor C is determined by resistance ratio of resistor $R_{10}$ to $R'_{10}$, that is, determined by the resistor $R_{10}$ so that the resistor $R_{10}$ may suitably adjusted to set the rotational speed of the internal combustion engine in which the voltage charged in the capacitor C reaches the Zener voltage of the Zener diode ZD.

For this reason, in the case of the embodiments shown in FIGS. 19 and 24, the resistor $R_{10}$ may be adjusted to freely set the rotational speed of the internal combustion engine to operate the overrotation prevention circuit ESG.

Since the operation of angle of lag in the embodiments shown in FIGS. 19 and 24 is entirely same as that of embodiments shown in FIGS. 18 and 23, description therefor will not be made.

Incidentally, the operating characteristic in the embodiments shown in FIGS. 18, 19, 23 and 24 is such that when the voltage charged in the capacitor C exceeds the Zener voltage of the Zener diode ZD, only the electric charge portion exceeded from the Zener voltage is discharged, that is, ignition timing of the ignition circuit CDI is delayed by the electric charge portion exceeded from the Zener diode. As shown in the characteristic diagrams of FIGS. 21 and 26, the operation of angle of lag begins at the set rotational speed (n) to start operation of the internal combustion engine. The width of angle of lag increases as the rotational speed of the internal combustion engine exceeds the rotational speed (n) making the latter as a reference.

Next, according to the embodiments shown in FIGS. 20 and 25, there is provided an arrangement wherein a discharge switch circuit Scl comprises a thyristor $SCR_1$ and discharging of capacitor C is achieved by thyristor $SCR_1$. The circuit shown in FIGS. 20 and 25 comprises a reverse-current blocking diode $D_7$ with its cathode connected to capacitor C inserted between trigger coil TC or generation coil GC and positive electrode of the capacitor C, a series circuit comprising a diode $D_8$ and a resistor $R_{10}$ inserted between the negative electrode of the capacitor C and the positive terminal of the trigger coil TC (in case of FIG. 25) or generation coil GC (in case of FIG. 20) to form a charging circuit Jcl, said series circuit having the entirely same in structure and operating object as that of the series circuit comprising the diode $D_8$ and the resistor $R_{10}$ *in the embodiments shown in FIGS.* 19 *and* 24 *as previously mentioned, and a thyristor* $SCR_1$ with its cathode connected to cathode of thyristor SCR inserted between the positive electrode of the capacitor C with the negative electrode connected to gate of the thyristor SCR and the cathode of the thyristor SCR, said thyristor $SCR_1$ forming a discharge switch circuit Scl with a Zener diode $ZD_1$ inserted between gate and anode thereof and a resistor $R_{13}$ in the form of a trigger resistor inserted between gate and cathode thereof.

In the case of the embodiments shown in FIGS. 20 and 25, an inverse voltage generated in the trigger coil TC or the generation coil GC is charged in the capacitor C by the charging circuit Jcl to be closed in order of the trigger coil TC or generation coil GC, the diode $D_7$, the capacitor C, the diode $D_8$, the resistor $R_{10}$, and the trigger coil TC or generation coil GC.

In this case, the voltage charged in the capacitor C is set by the resistor $R_{10}$.

When the voltage charged in the capacitor C is lower than the Zener voltage of the Zener diode $ZD_1$, the overrotation prevention circuit ESG is not in operation, and the thyristor SCR in the ignition circuit CDI is triggered at the normal time and the electric charge charged in the capacitor C is discharged through the resistor $R_{12}$ connected in parallel with the capacitor C.

When the voltage charged in the capacitor C exceeds the Zener voltage of the Zener diode $ZD_1$ resulted from overrotation condition of the internal combustion engine for some cause or other, the Zener diode $ZD_1$ is broken down so that a trigger current passes into the resistor $R_{13}$ to trigger the thyristor $SCR_1$, and as a consequence, a discharging circuit Hcl comprising the capacitor C, the thyristor $SCR_1$, the resistor $R_8$, and the capacitor C is formed to cause the inverse voltage charged in the capacitor C to be discharged through the resistor $R_8$, whereby the gate of the thyristor SCR is negatively biased relative to the cathode thereof to place the thyristor SCR in non-triggering condition.

This non-triggering condition of the thyristor SCR is maintained until all the electric charge charged in the capacitor is discharged, and accordingly, as may be seen in FIGS. 22 and 27, the operating characteristics of an angle of lag are such that when rotational speed (n) set by the resistor $R_{10}$ (when the rotational speed of the internal combustion engine reaches the aforesaid rotational speed (n), the Zener diode $ZD_1$ is broken down to trigger the thyristor $SCR_1$) is reached, the ignition time of ignition circuit CDI is abruptly delayed by the width of angle of lag $\Delta\theta$ corresponding to the quantity of charge of the capacitor C at the time of rotational speed (n), and in the case where the rotational speed exceeds the rotational speed (n), the ignition time is delayed while adding the width of angle of lag in proportion to the aforementioned exceeded portion to the aforesaid width of angle of lag $\Delta\theta$.

In the case of the embodiments shown in FIGS. 20 and 25, the ignition time is abruptly delayed by the width of angle of lag $\Delta\theta$ at the time when the rotational speed of the internal combustion engine reaches the rotational speed (n) set by the resistor $R_{10}$, and hence, the operation of angle of lag with the rotational speed (n) as a boundary, that is, the overrotation prevention force acts more rapidly than that of embodiments shown in FIGS. 18, 19, 23 and 24 as previously mentioned.

According to the embodiments shown in FIGS. 20 and 25, all the voltage charged in the capacitor may be utilized for the operation of angle of lag so that a greater width of angle of lag than that of the embodiments shown in FIGS. 18, 19, 23 and 24 can be secured.

For this reason, the circuits shown in FIGS. 20 and 25 are preferably incorporated in internal combustion engines of which load is often rapidly changed from full-load to no-load, whereas the circuits shown in FIGS. 18, 19, 23 and 24 are preferably incorporated in internal combustion engines of which load is gradually changed and rotational speed is not rapidly changed.

It will of course be understood in the embodiments shown in FIGS. 20 and 25 that a trigger coil exclusively used for triggering the thyristor $SCR_1$ may be employed in place of the trigger circuit of the thyristor $SCR_1$ operated in accordance with the voltage charged in the capacitor C.

In accordance with the overrotation prevention circuit ESG shown in FIGS. 18–20 and 23–25, when the rotational speed of the internal combustion engine reaches the rotational speed (n) to be set, ignition timing of the ignition circuit CDI may be delayed by the width in accordance with the discharging constant of the discharging circuit of the capacitor C to inevitably decrease the rotational speed of the internal combustion engine, thereby unforciably and positively prevent overrotation.

Further, the greater the electric charge charged in the capacitor C, the greater will be the width of angle of lag, and accordingly, the greater the degree of overrotation of the internal combustion engine, the greater will be the overrotation prevention force, similarly to the embodiment in the above-mentioned induction discharge type ignition circuit TCI.

According to the embodiments shown in FIGS. 28, 29, and 32, there is provided an overrotation prevention circuit ESG applied to the induction discharge type ignition circuit TCI, wherein charging of an inverse voltage in the capacitor C is achieved by those other than the ignition coil T in the ignition circuit TCI. Thus, the circuit ESG may be electrically separated from the ignition coil T which forms a principal element in the ignition circuit TCI to elimate an inconvenient electrical influence exerted between the circuit ESG and the ignition circuit TCI, thereby securing positive and accurate operation.

The embodiment shown in FIG. 28 provides an arrangement wherein a trigger coil $TC_1$ for triggering a thyristor $SCR_1$ forming a discharge switch circuit Scl comprises a power supply for charging the capacitor C. The circuit shown in FIG. 28 comprises a series circuit comprising a trigger coil $TC_1$ and a current-limiting resistor $R_{14}$ and a parallel circuit of a resistor $R_{13}$ in the form of a gate resistor inserted between gate and cathode of a thyristor $SCR_1$ forming a discharge switch circuit Scl with cathode thereof connected to cathode of thyristor SCR, said thyristor $SCR_1$ having its anode connected to gate of thyristor SCR through capacitor C and diode $D_1$, a diode $D_7$ with cathode connected to the capacitor C inserted between the negative terminal of the trigger coil $TC_1$ connected to cathode of the thyristor $SCR_1$ and the anode of the capacitor C, a series circuit comprising a resistor $R_{10}$ in the form of a variable resistor and a diode $D_8$ with cathode connected to the trigger coil $TC_1$ inserted between the cathode of the capacitor C and the positive terminal of the trigger coil $TC_1$ to form a charging circuit Jcl, and a resistor $R_{12}$ forming a second discharging circuit $Hcl_2$ connected in parallel with the capacitor C.

The discharging circuit Hcl in the circuit ESG shown in FIG. 28 comprises a resistor $R_4$ forming a gate circuit of the thyristor SCR in the ignition circit TCI similarly to the embodiments shown in FIGS. 7, 8, and 9 as previously mentioned.

The embodiment shown in FIG. 29 provides an arrangement wherein a power supply for charging the capacitor C comprises an exclusive-use charging coil JC. The circuit shown in FIG. 29 comprises a thyristor $SCR_1$ forming a discharging switch circuit Scl with cathode thereof connected to cathode of thyristor SCR, said thyristor $SCR_1$ having its anode connected to gate of the thyristor SCR through a diode $D_1$ forming a gate circuit of the thyristor SCR from the capacitor C, a diode $D_7$ with anode connected to the cathode of the thyristor $SCR_1$ inserted between the cathode of the thyristor $SCR_1$ and the anode of the capacitor C, a series circuit comprising a resistor $R_{10}$, a diode $D_8$, and a charging coil JC inserted between the cathode of the capacitor C and the cathode of the thyristor $SCR_1$ to form a charging circuit Jcl, a resistor $R_{12}$ forming a second discharging circuit $Hcl_2$ connected in parallel with the capacitor C, a Zenor diode $ZD_1$ inserted between anode and gate of the thyristor $SCR_1$ similarly to that shown in FIGS. 5, 8, 20, and 25, and a resistor $R_{13}$ inserted between gate and cathode thereof to form a gate circuit for setting the trigger time of the thyristor $SCR_1$.

That is, in accordance with the overrotation prevention circuit shown in FIG. 28, the trigger coil $TC_1$ of the thyristor $SCR_1$ forming a discharge switch circuit Scl serves as a power supply for charging the capacitor C. the charging circuit Jcl comprises the trigger coil $TC_1$, the diode $D_7$, the capacitor C, the resistor $R_{10}$, the diode $D_8$, and the trigger coil $TC_1$.

The value of the inverse voltage charged in the capacitor C through the charging circuit Jcl is determined by the resistor $R_{10}$ in a manner similar to that of the above-mentioned embodiment.

In the case of the embodiment shown in FIG. 28, the magnitude of the inverse voltage charged in the capacitor C is not directly related to the time of operating the overrotation prevention circuit ESG, and commencement of operation of the circuit ESG is independently set by the resistor $R_{14}$.

That is, the trigger coil $TC_1$ is arranged opposedly to a flywheel (not shown) similarly to the ignition coil T to thereby generate an induced voltage which increases and decreases in proportion to the rotational speed of the internal combustion engine, and the value of resistor $R_{14}$ is set so that a voltage drop at the resistor $R_{13}$ reaches the trigger voltage of the thyristor $SCR_1$ when the rotational speed of the internal combustion engine reaches the value of overrotation, whereby the thryristor $SCR_1$ may be triggered irrespective of the charged voltage of the capacitor C.

On the other hand, charging of an inverse voltage in the capacitor C is achieved by the inversely induced voltage of the trigger coil $TC_1$ which is not at all related to triggering of the thyristor $SCR_1$, and accordingly, at the time when the thyristor $SCR_1$ is triggered, it is assured that a given inverse voltage is charged in the capacitor C.

In the case of the embodiment shown in FIG. 28, the capacitor C must be charged by the trigger coil $TC_1$; and hence, the grigger coil $TC_1$ must have a voltage inducing capacity in excess of a certain degree. However, if the trigger coil $TC_1$ is merely provided to trigger the thyristor $SCR_1$, the voltage inducing capacity to a degree as noted above is not required.

For this reason, the trigger coil $TC_1$ is excessively great in capacity as far as the thyristor $SCR_1$ is triggered. Therefore, the gate circuit of the thyristor $SCR_1$ incorporates therein, in addition to the resistor $R_{13}$, the current-limiting resistor $R_{14}$ connected in series with the trigger coil $TC_1$ so as to consume the induced voltage of the trigger coil $TC_1$ which is excessive in capacity as far as the thyristor $SCR_1$ is triggered.

On the other hand, in accordance with the overrotation prevention circuit ESG shown in FIG. 29, charging of the capacitor C is achieved by the exclusive-use charging coil JC so that the thyristor $SCR_1$ may be triggered in accordance with the voltage charged in the capacitor C.

Thus, in the embodiment shown in FIG. 29, charging of the capacitor C is achieved by the charging coil JC disposed independently of the ignition circuit TCI. However, timing of charging of the capacitor C by the charging coil JC is set so that an induced voltage $V_4$ of the charging coil JC is produced at the same timing as that when an inverse voltage of the ignition coil T is produced, as shown in FIG. 30.

Further, the thyristor $SCR_1$ is triggered by detecting the charged voltage of the capacitor C through the Zener diode $ZD_1$ and the charged voltage of the capacitor C is set by the resistor $R_{10}$, and after all, the time of starting the operation of the circuit ESG is set by the resistor $R_{10}$.

Thus, in accordance with the circuit ESG shown in FIGS. 28 and 29, the capacitor C is not charged by the ignition coil T or generation coil GC or trigger coil TC, which are members constituting the aforementioned ignition circuit TCI or CDI, and therefore, the circuit ESG has its charging power supply independently of the ignition circuit TCI and forms the charging circuit Jcl. Accordingly, the electric charge charged in the capacitor C may freely be set to thereby obtain an optimum discharging time or width of angle of lag without being controlled by the circuit structure of the ignition circuit TCI.

Moreover, position for starting an angle of lag of the ignition timing (rotational speed) may be set irrespective of the ignition circuit TCI, whereby an accurate and positive arrangement can be secured to obtain a stabilized operation.

In the overrotation prevention circuit in the circuit ESG shown in FIGS. 28 and 29, the thyristor $SCR_1$ is triggered to discharge all the inverse voltage charged in the capacitor C, of which operating characteristic is as shown in FIG. 31.

Finally, an embodiment shown in FIG. 32 provides an arrangement wherein an exclusive-use charging coil JC is provided to charge an inverse voltage of the capacitor C, similarly to the embodiment shown in FIG. 29, with the exception that a discharge switch circuit Scl comprises a Zener diode ZD.

The circuit shown in FIG. 32 comprises a series circuit comprising a capacitor C and a Zener diode ZD forming a discharge switch circuit Scl with cathode thereof connected to gate of thyristor SCR, said series circuit being inserted between gate and cathode of the thyristor SCR, a series circuit comprising a charging coil JC and a diode $D_8$ with its anode connected to the cathode of the capacitor connected in parallel with the capacitor C, and a resistor $R_{12}$ forming a second discharging circuit $Hcl_2$ connected in parallel with the capacitor C.

In the ignition circuit TCI in the embodiment shown in FIG. 32, a diode $D_3$ connected in parallel with a primary winding $T_1$ is essentially provided to prevent premature ignition of the ignition circuit TCI but is effectively used to form the discharging circuit Hcl in the circuit ESG.

Thus, in the embodiment shown in FIG. 32, the capacitor C is charged by the exclusive-use charging coil JC, and the circuit of FIG. 32 is very simple and operates in the same form as that of embodiments shown in FIGS. 13 and 14.

That is, an inverse voltage charged in the capacitor C through a circuit comprising the charging coil JC, the capacitor C, the diode $D_8$, and the charging coil JC reaches the value set by the Zener diode ZD, then the Zener diode ZD is broken down to form a discharging circuit comprising the capacitor C, the primary winding $T_1$ (or diode $D_2$), the resistors $R_2$ and $R_3$, the Zener diode ZD, and the capacitor C, and as a consequence, the thyristor SCR is negatively biased in gate relative to the cathode thereof to disable triggering of the thyristor SCR until the charged voltage of the capacitor C is discharged, that is, for a period of time in accordance with time constant determined by the capacitor C and the resistors $R_2$ and $R_3$, thus delaying triggering of the thyristor SCR.

This action of angle of lag due to the circuit ESG is in proportion to the discharging time of the charged electric charge of the capacitor in excess of the Zener voltage of the Zener diode resulted from the breakdown of the Zener diode ZD, and the voltage charged in the capacitor C is in proportion to the induced voltage of the charging coil JC which increases in proportion to the rotational speed of the internal combustion engine, and accordingly, the operating characteristic of the circuit ESG is such that as shown in FIG. 35, when the rotational speed of the internal combustion engine exceeds a rotational speed (n) at which the Zener diode ZD is broken down, the width of angle of lag increases in proportion to the amount exceeding the aforesaid rotational speed (n).

Further, the operation of angle of lag in the circuit ESG changes in state from normal rotation shown in FIG. 33 to overrotation shown in FIG. 34. However, in a gate voltage waveform of the thyristor SCR shown in FIG. 34 (b), which illustrates the operation of circuit ESG, a gate potential $v_2$ of the thyristor SCR, which has been returned to positive potential from negative potential at the time earlier than the normal ignition time $t_1$ in normal rotation, is delayed to be returned to positive potential from negative potential by the discharge of the inverse voltage charged in the capacitor C resulted from the operation of the circuit ESG, and as a consequence, the thyristor SCR is triggered at time $t_2$ delayed by the time in accordance with constant set by the charged voltage portion of the capacitor C discharged and the resistors $R_2$ and $R_3$.

That is, ignition time of the ignition circuit TCI is delayed from time $t_1$ to $t_2$.

Thus, in accordance with the embodiment shown in FIG. 32, the exclusive-use charging coil JC is provided as a power supply for charging an inverse voltage in the capacitor C, so that charging of the capacitor C may be achieved irrespective of various conditions on circuit structure of the ignition circuit TCI and in addition, the charging value may be set.

As will be apparent from the foregoing description of various embodiments, the present invention provides gate control method and gate control circuit essentially incorporating a capacitor C, the method utilizing a capacitor C to control the gate of thyristor SCR in an ignition circuit TCI or CDI in which conduction and cut-off of a primary short-circuit current passing through a primary winding $T_1$ are controlled by on and off of the thyristor SCR. In accordance with the basic mode of operation of the gate control circuit, an inverse voltage charged in the capacitor C connected to the gate of the thyristor SCR is discharged when rotational speed of the internal combustion engine is in overrotation to delay time reaching a trigger potential of gate potential of the thyristor SCR.

For this reason, the circuit of the present invention is completely electrically operated and all that need be done is to discharge the capacitor C, and accordingly, the circuit structure is simple and positive without malfunction. In addition, the form of action and operation of the circuit may suitably be set to provide an optimum operation of angle of lag for the running conditions of the internal combustion engine to be employed.

Further, the width of angle of lag, that is, the degree of overrotation prevention force according to the present invention may be set within the circuit ESG irrespective of the ignition circuit TCI or CDI, and also, rotational speed of the internal combustion engine for starting operation of the circuit ESG may be set only within the circuit ESG, and hence, there is no possible adverse influence on the operation of the ignition circuit TCI or CDI at the time of normal operation, thus affording a good effect as a safety device.

Moreover, according to the present invention, the overrotation prevention force of the internal combustion engine becomes powerful as overrotation of the internal combustion engine increases, and hence, operation and effect thereof is positive and extremely reliable.

In particular, in the case where the circuit of the invention is applied to the induction discharge type ignition circuit TCI, an inverse induced voltage in the primary winding $T_1$, which produces various inconveniences such as premature ignition in achievement of smooth operation of the ignition circuit TCI, may be utilized as a power supply for charging the capacitor C to cause a reverse-current to be passed into the primary winding $T_1$, thus affording effects of providing good operation of the ignition circuit TCI itself and simplification of circuit structure of the ignition circuit TCI.

In the case of the induction discharge type ignition circuit TCI, the width of angle of lag according to the present invention is limited (the value of the primary short-circuit current is limited within the range in which spark discharge is produced in plug P of a secondary winding $T_2$), whereas in the case of the capacity discharge type ignition circuit CDI, an electric charge charged in the capacitor $C_1$ can merely be discharged through the primary winding $T_1$, and hence, the width of angle of lag is never limited.

It will be noted however that in the case of the capacity discharge type ignition circuit CDI, if the width of angle of lag is designed to be increased, a high inverse voltage is developed across both terminals of the capacitor $C_1$ and the thyristor SCR, and for this reason, it is necessary to use capacitor C and thyristor SCR that may sufficiently withstand inverse voltage or to incorporate a withstand inverse voltage protective circuit.

What is claimed is:

1. A method for prevention of overrotation in a non-contact ignition circuit for an internal combustion engine, said non-contact ignition circuit comprising: an ignition coil T, the primary winding T1 of said ignition coil T carrying a primary current, said primary current controlled in its flow by the conduction or non-conduction of a thyristor SCR; onset of conduction of said thyristor causing a high voltage in the secondary winding T2 of said coil T; and, a capacitor C connected to the gate of said thyristor SCR, including the steps of:

(a) inducing a forward voltage and current flow in said primary winding T1;

(b) applying said forward voltage to said gate of said thyristor SCR whereby said thyristor SCR conducts to produce said high voltage in said secondary T2 when said gate voltage reaches the trigger voltage of said thyristor SCR;

(c) inducing an inverse voltage in said primary winding T, following said forward voltage, (d) charging said capacitor C with said inverse voltage;

(e) discharging said capacitor C via said connection to said thyristor gate when said engine rotation rate exceeds a preselected value, whereby said thyristor SCR is non-conductive and said high voltage is not produced in said secondary winding T2 when said capacitor C discharges.

2. The method of claim 1 wherein a spark plug P is connected to said secondary winding T2, said plug P sparking when said high voltage is produced in said secondary winding T2.

3. The method of claim 1 wherein said forward and inverse voltages are proportional in magnitude to the rotation rate of said internal combustion engine.

4. The method of claim 1 wherein said non-contact ignition circuit further comprises a trigger circuit to cause said capacitor C to discharge wehn said rotation rate exceeds said preselected value, said trigger circuit being part of the discharge patch of said capacitor C, said trigger circuit dischargning said capacitor C when the forward voltage in said trigger circuit exceeds a preselected value of voltage, said preselected trigger voltage value being in relation to said peselected value of rotation rate; including the further step of:

(f) inducing said forward voltage in said trigger circuit, said induced forward trigger voltage being proportional in magnitude to the rotation rate of said internal combustion engine.

5. The method of claim 4 wherein said trigger circuit includes an induction coil TC, said voltage in said trigger circuit being induced in said coil TC, said forward voltage in said coil TC being applied to the gate of a thyristor $SCR_1$, the load terminals of said thyristor $SCR_1$, being in said discharge path of said capacitor C.

6. The method of claim 5 wherein an inverse voltage induced in said coil TC is charged into said capacitor C.

7. The method of claim 1 wherein said current discharging from said capacitor C to said thyristor gate reduces the bias on said thyristor gate to prevent conduction of said thyristor SCR during said capacitor discharge.

* * * * *